US010127874B2

(12) United States Patent
Park et al.

(10) Patent No.: US 10,127,874 B2
(45) Date of Patent: Nov. 13, 2018

(54) SCAN DRIVER AND DISPLAY DEVICE USING THE SAME

(71) Applicant: SAMSUNG DISPLAY CO., LTD., Yongin-si, Gyeonggi-do (KR)

(72) Inventors: Su Hyeong Park, Yongin-si (KR); Ho Yong Jung, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 272 days.

(21) Appl. No.: 15/003,402

(22) Filed: Jan. 21, 2016

(65) Prior Publication Data

US 2016/0314737 A1 Oct. 27, 2016

(30) Foreign Application Priority Data

Apr. 23, 2015 (KR) ..... 10-2015-0057321

(51) Int. Cl.
*G09G 3/36* (2006.01)

(52) U.S. Cl.
CPC ..... *G09G 3/3677* (2013.01); *G09G 2330/021* (2013.01)

(58) Field of Classification Search
CPC ..... G09G 3/3677; G09G 2310/0267; G09G 2310/0286; G11C 19/184; G11C 19/28; G11C 19/287
USPC ..... 345/98, 100; 377/64–81
See application file for complete search history.

(56) References Cited

U.S. PATENT DOCUMENTS

| | | | | |
|---|---|---|---|---|
| 8,686,990 | B2 | 4/2014 | Yamamoto | |
| 8,816,728 | B2 | 8/2014 | Yoon et al. | |
| 2008/0055293 | A1* | 3/2008 | Kuo | G09G 3/3648 345/204 |
| 2015/0070343 | A1 | 3/2015 | Lee et al. | |
| 2015/0194110 | A1 | 7/2015 | Park et al. | |
| 2016/0064098 | A1* | 3/2016 | Han | G11C 19/28 345/211 |

FOREIGN PATENT DOCUMENTS

| | | | |
|---|---|---|---|
| KR | 10-2013-0010714 | A | 1/2013 |
| KR | 10-2013-0083151 | A | 7/2013 |
| KR | 10-2014-0127378 | A | 11/2014 |
| KR | 10-2015-0030503 | A | 3/2015 |
| KR | 10-2015-0082774 | A | 7/2015 |

* cited by examiner

*Primary Examiner* — Michael Pervan
(74) *Attorney, Agent, or Firm* — Lewis Roca Rothgerber Christie LLP

(57) ABSTRACT

There is provided a scan driver including a plurality of stages coupled to respective scan lines, wherein a kth (where k is a natural number) stage of the plurality of stages includes: a first driver configured to supply a kth scan signal to a first output terminal, based on a first clock signal, and a second driver configured to supply a kth carry signal not overlapping the kth scan signal to a second output terminal, based on an inverse first clock signal.

19 Claims, 16 Drawing Sheets

SCAN DRIVER AND DISPLAY DEVICE USING THE SAME

CROSS-REFERENCE TO RELATED APPLICATION

This application claims priority to and the benefit of Korean Patent Application No. 10-2015-0057321, filed on Apr. 23, 2015, in the Korean Intellectual Property Office, the entire content of which is incorporated herein by reference in its entirety.

BACKGROUND

1. Field

An aspect of the present invention relates to a scan driver and a display device using the same.

2. Description of the Related Art

With the development of information technologies, the importance of a display device, which is a connection medium between a user and information increases. Accordingly, display devices such as a liquid crystal display device (LCD) and an organic light emitting display device (OLED) are increasingly used.

In general, a display device includes a data driver for supplying data signals to data lines, a scan driver for supplying scan signals to scan lines, and a pixel unit including pixels positioned in an area defined by the scan lines and the data lines.

Such a display device is applied to various portable devices including cellular phones. Thus, it is desirable to reduce or minimize power consumption such that the display device may be stably used for a long period of time.

SUMMARY

Aspects of embodiments of the present invention are directed toward a scan driver and a display device using the same, which may reduce power consumption.

According to some aspects of the present invention, there is provided a scan driver including: a plurality of stages coupled to respective scan lines, wherein a kth (where k is a natural number) stage of the plurality of stages includes: a first driver configured to supply a kth scan signal to a first output terminal, based on a first clock signal; and a second driver configured to supply a kth carry signal not overlapping the kth scan signal to a second output terminal, based on an inverse first clock signal.

In an embodiment, the first driver includes: a first output unit configured to supply the kth scan signal to the first output terminal, based on the first clock signal input to a first input terminal, a (k+1)th carry signal input to a fifth input terminal, the kth carry signal, and voltages of a first node and a second node; a first controller configured to control the voltage of the second node, based on the first clock signal; and a pull-up unit configured to control the voltage of the first node, based on a (k−1)th carry signal input to a second input terminal, a reset signal input to a fourth input terminal, and the kth carry signal.

In an embodiment, the first output unit is further configured to generate an internal carry signal having a same waveform as the kth scan signal.

In an embodiment, the second driver includes: a second output unit configured to supply the kth carry signal to the second output terminal, based on the inverse first clock signal input to a third input terminal, the (k+1)th carry signal, and voltages of a third node and a fourth node electrically coupled to the second node; and a second controller configured to control the voltage of the third node, based on the kth scan signal or the internal carry signal, the reset signal, and the (k+1)th carry signal.

In an embodiment, the second output unit includes: a first transistor coupled between the third input terminal and the second output terminal, the first transistor having a gate electrode coupled to the third node; a second transistor coupled between the second output terminal and a second power input terminal supplied with a second off voltage, the second transistor having a gate electrode coupled to the fourth node; a third transistor coupled between the second output terminal and the second power input terminal, the third transistor having a gate electrode coupled to the fifth input terminal; and a first capacitor coupled between the third node and the second output terminal.

In an embodiment, the second controller includes: a fourth transistor configured to be diode-coupled, and to turn on when the kth scan signal or the internal carry signal is supplied to increase the voltage of the third node to a gate-on voltage; a fifth transistor coupled between the third node and a second power input terminal supplied with the second off voltage, the fifth transistor having a gate electrode coupled to the fifth input terminal; a sixth transistor coupled between the third node and the second power input terminal, the sixth transistor having a gate electrode coupled to the fourth node; and a seventh transistor coupled between the third node and the second power input terminal, the seventh transistor having a gate electrode coupled to the fourth input terminal.

In an embodiment, the first output unit includes: a first transistor coupled between the first input terminal and the first output terminal, the first transistor having a gate electrode coupled to the first node; a second transistor coupled between the first output terminal and a first power input terminal supplied with a first off voltage, the second transistor having a gate electrode coupled to the second node; a third transistor coupled between the first output terminal and the first power input terminal, the third transistor having a gate electrode coupled to the second output terminal; a fourth transistor coupled between the first output terminal and the first power input terminal, the fourth transistor having a gate electrode coupled to the fifth input terminal; and a first capacitor coupled between the first node and the first output terminal.

In an embodiment, the first output unit includes: a fifth transistor coupled between the first input terminal and a carry terminal to output the internal carry signal, the fifth transistor having a gate electrode coupled to the first node; a sixth transistor coupled between the carry terminal and the second power input terminal supplied with the second off voltage, the second off voltage being different from the first off voltage, the sixth transistor having a gate electrode coupled to the second output terminal; and a seventh transistor coupled between the carry terminal and the second power input terminal, the seventh transistor having a gate electrode coupled to the second node.

In an embodiment, the first controller includes: an eighth transistor having a first electrode and a gate electrode, coupled to the first input terminal; a ninth transistor coupled between a second electrode of the eighth transistor and a second power input terminal supplied with the second off voltage, the ninth transistor having a gate electrode coupled to the first output terminal; a tenth transistor coupled between the first input terminal and the second node, the tenth transistor having a gate electrode coupled to the second electrode of the eighth transistor; and an eleventh transistor coupled between the second node and the second power input terminal, the eleventh transistor having a gate electrode coupled to the first output terminal.

In an embodiment, the pull-up unit includes: a twelfth transistor having a gate electrode and a first electrode, coupled to the second input terminal; a thirteenth transistor coupled between a second electrode of the twelfth transistor and a second power input terminal supplied with the second off voltage, the thirteenth transistor having a gate electrode coupled to the second output terminal; a fourteenth transistor coupled between the second electrode of the twelfth transistor and the second power input terminal, the fourteenth transistor having a gate electrode coupled to the second node; a fifteenth transistor coupled between the first node and the second power input terminal, the fifteenth transistor having a gate electrode coupled to the fifth input terminal; and a sixteenth transistor coupled between the first node and the second power input terminal, the sixteenth transistor having a gate electrode coupled to the fourth input terminal.

According to some aspects of the present invention, there is provided a display device including: i (where i is a natural number of 2 or more) scan drivers configured to supply scan signals to scan lines; a plurality of blocks, each of the plurality of blocks including 2i scan lines; a data modifier configured to generate second data by rearranging first data supplied from the outside in units of the blocks; and a signal generator configured to sequentially or non-sequentially control a supply order of scan signals in units of the blocks, based on the second data.

In an embodiment, the signal generator is configured to supply a clock signal and an inverse clock signal to each of the i scan drivers, and wherein high periods of clock signals supplied to the respective i scan drivers do not overlap each other.

In an embodiment, the i scan drivers are sequentially coupled to different scan lines in each of the blocks.

In an embodiment, the signal generator is further configured to control the supply order of the scan signals in units of the blocks by controlling a supply order of clock signals and inverse clock signals respectively supplied to the i scan drivers.

In an embodiment, each of the i scan drivers is configured to sequentially supply scan signals to scan lines coupled thereto.

In an embodiment, each of the i scan drivers includes a plurality of stages, and wherein at least one of the plurality of stages includes: a first driver configured to supply a kth scan signal to a first output terminal, based on a first clock signal; and a second driver configured to supply a kth carry signal not overlapping the kth scan signal to a second output terminal, based on an inverse first clock signal.

In an embodiment, the first driver includes: a first output unit configured to supply the kth scan signal to the first output terminal, based on the first clock signal input to a first input terminal, a (k+1)th carry signal input to a fifth input terminal, the kth carry signal, and voltages of a first node and a second node; a first controller configured to control the voltage of the second node, based on the first clock signal; and a pull-up unit configured to control the voltage of the first node, based on a (k−1)th carry signal input to a second input terminal, a reset signal input to a fourth input terminal, and the kth carry signal.

In an embodiment, the second driver includes: a second output unit configured to supply the kth carry signal to the second output terminal, based on the inverse first clock signal input to a third input terminal, the (k+1)th carry signal, and voltages of a third node and a fourth node electrically coupled to the second node; and a second controller configured to control the voltage of the third node, based on the kth scan signal, the reset signal, and the (k+1)th carry signal.

In an embodiment, the second output unit includes: a first transistor coupled between the third input terminal and the second output terminal, the first transistor having a gate electrode coupled to the third node; a second transistor coupled between the second output terminal and a second power input terminal supplied with a second off voltage, the second transistor having a gate electrode coupled to the fourth node; a third transistor coupled between the second output terminal and the second power input terminal, the third transistor having a gate electrode coupled to the fifth input terminal; and a first capacitor coupled between the third node and the second output terminal.

In an embodiment, the second controller includes: a fourth transistor configured to be diode-coupled, and to turn on when the kth scan signal is supplied to increase the voltage of the third node to a gate-on voltage; a fifth transistor coupled between the third node and a second power input terminal supplied with the second off voltage, the fifth transistor having a gate electrode coupled to the fifth input terminal;

a sixth transistor coupled between the third node and the second power input terminal, the sixth transistor having a gate electrode coupled to the fourth node; and a seventh transistor coupled between the third node and the second power input terminal, the seventh transistor having a gate electrode coupled to the fourth input terminal.

In the scan driver and the display device using the same, according to embodiments of the present invention, the supply order of data is changed in units of blocks, so that power consumption may be reduced or minimized. Further, the supply order of clock signals and inverse clock signals supplied to scan drivers is controlled, so that the supply order of scan signals may be changed corresponding to the change in the supply order of data.

BRIEF DESCRIPTION OF THE DRAWINGS

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey the scope of the example embodiments to those skilled in the art.

In the drawing figures, dimensions may be exaggerated for clarity of illustration. Like reference numerals refer to like elements throughout.

DETAILED DESCRIPTION

In the following detailed description, only certain exemplary embodiments of the present invention have been shown and described, simply by way of illustration. As those skilled in the art would realize, the described embodiments may be modified in various different ways, all without departing from the spirit or scope of the present invention. Accordingly, the drawings and description are to be regarded as illustrative in nature and not restrictive.

Figure 1:
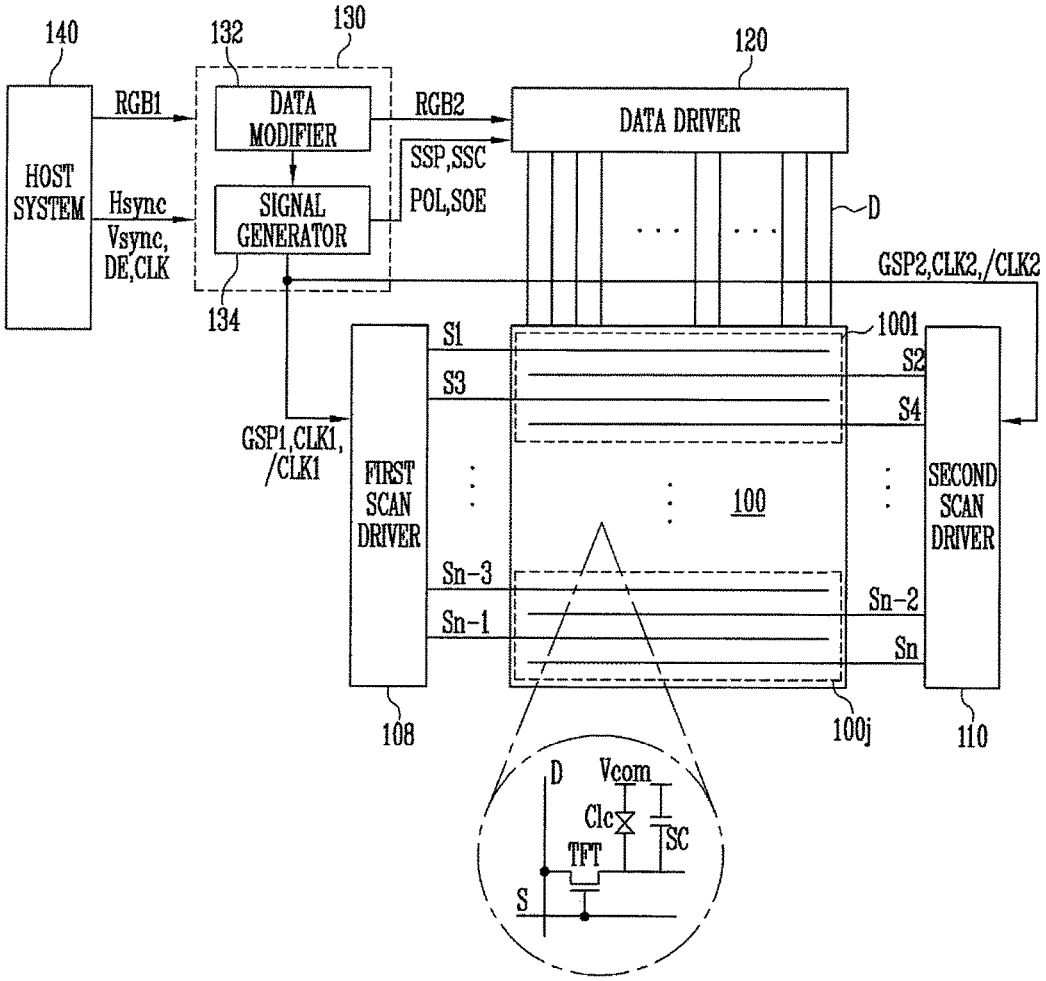
FIG. 1 is a diagram schematically illustrating a display device according to an embodiment.

FIG. 1 is a diagram schematically illustrating a display device according to an embodiment of the present invention. In FIG. 1, it is assumed that, for convenience of illustration, the display device is a liquid crystal display device. However, the present invention is not limited thereto.

Referring to FIG. 1, the display device according to the embodiment of the present invention includes a pixel unit 100, scan drivers 108 and 110, a data driver 120, and a timing controller 130.

The pixel unit 100 refers to an effective display unit of a liquid crystal panel. The liquid crystal panel includes a thin film transistor (hereinafter, referred to as "TFT") substrate and a color filter substrate. A liquid crystal layer is formed between the TFT substrate and the color filter substrate. Data lines D and scan lines S are formed on the TFT substrate, and a plurality of pixels are arranged in areas defined by the scan lines S and the data lines D.

A TFT included in each pixel transmits, to a liquid crystal capacitor CIc, a voltage of a data signal supplied via a data line D in response to a scan signal from a scan line S. To this end, a gate electrode of the TFT is coupled to the scan line S, and a first electrode of the TFT is coupled to the data line D. A second electrode of the TFT is coupled to the liquid crystal capacitor Clc and a storage capacitor SC.

Here, the first electrode refers to any one of source and drain electrodes of the TFT, and the second electrode refers to an electrode different from the first electrode. For example, when the first electrode is set as the drain electrode, the second electrode is set as the source electrode. Also, a pixel electrode, a common electrode, and liquid crystals between the pixel electrode and the common electrode are equivalently expressed as the liquid crystal capacitor CIc. The storage capacitor SC maintains a voltage of a data signal transmitted to the pixel electrode for a time (e.g., a predetermined time) until a next data signal is supplied.

A black matrix, color filters, and the like are formed on the color filter substrate.

In a vertical electric field driving manner, such as a twisted nematic (TN) mode and a vertical alignment (VA) mode, the common electrode is formed on the color filter substrate. In a horizontal electric field driving manner, such as an in-plane switching (IPS) mode and a fringe field switching (FFS) mode, the common electrode is formed together with the pixel electrode on the TFT substrate. A common voltage Vcom is supplied to the common electrode. The liquid crystal mode of the liquid crystal panel may be implemented as any liquid crystal mode as well as the TN mode, the VA mode, the IPS mode, and/or the FFS mode, which are described above.

Meanwhile, in this embodiment, the pixel unit 100 is divided into a plurality of blocks 1001 to 100*j* (where j is a natural number). Each of the blocks 1001 to 100*j* includes a plurality of scan lines S.

For example, when i (where i is a natural number of 2 or more) scan drivers are included in the display device, each of the blocks 1001 to 100*j* may include 2i scan lines. In other words, when two scan drivers 108 and 110 are included in the display device as shown in FIG. 1, each of the blocks 1001 to 100*j* may include 4 scan lines.

A first scan driver 108 and a second scan driver 110 are sequentially coupled to different scan lines S. For example, the first scan driver 108 may be coupled to odd-numbered scan lines S1, S3, . . . , and Sn−1, and the second scan driver 110 may be coupled to even-numbered scan lines S2, S4, . . . , and Sn. The first scan driver 108 and the second scan driver 110 sequentially or non-sequentially supply scan signals in units of the blocks 1001 to 100*j* under control of a signal generator 134.

For example, the first scan driver 108 sequentially supplies scan signals to the odd-numbered scan lines S1, S3, . . . , and Sn−1. The second scan driver 110 sequentially supplies scan signals to the even-numbered scan lines S2, S4, . . . , and Sn. However, the supply order of the scan signals supplied from the first scan driver 108 and the scan signals supplied from the second scan driver 110 in units of the blocks may be changed.

In a first block 1001, the first scan driver 108 supplies scan signals in an order of a first scan line S1 and a third scan line S3, and the second scan driver 110 supplies scan signals in an order of a second scan line S2 and a fourth scan line S4. Here, the supply order of the scan signals between the scan drivers 108 and 110 is controlled by clock signals CLK1, /CLK1, CLK2, and /CLK2 supplied from the signal generator 134.

For example, the supply order of the scan signals may be set as an order of the first scan line S1, the third scan line S3, the second scan line S2, and the fourth scan line S4 by the clock signals CLK1, /CLK1, CLK2, and /CLK2. Alternatively, the supply order of the scan signals may be set as an order of the second scan line S2, the first scan line S1, the third scan line S3, and the fourth scan line S4 by the clock signals CLK1, /CLK1, CLK2, and /CLK2.

To this end, the first scan driver 108 and the second scan driver 110 are driven by clock signals CLK1 and CLK2 and inverse clock signals /CLK1 and /CLK2 obtained by inverting the clock signals, respectively. In other words, the first scan driver 108 is driven by a first clock signal CLK1 and an inverse first clock signal /CLK1, and the second scan driver 110 is driven by a second clock signal CLK2 and an inverse second clock signal /CLK2. Here, high levels of the first clock signal CLK1 and the second clock signal CLK2 do not overlap each other.

The timing controller 130 includes a data modifier 132 and the signal generator 134. The data modifier 132 generates second data RGB2 by rearranging first data RGB1 supplied from a host system 140, and supplies the generated second data RGB2 to the data driver 120. Here, the data modifier 132 generates the second data RGB2 by rearranging the first data RGB1 in units of blocks such that power consumption is reduced or minimized. Hereinafter, for convenience of illustration, it is assumed that the data modifier 132 rearranges the second data RGB2 such that a data signal is supplied in an order of a first horizontal line, a third horizontal line, a second horizontal line, and a fourth horizontal line in the first block 1001.

The signal generator 134 supplies a gate control signal to the scan driver 110 based on timing signals such as a vertical synchronization signal Vsync, a horizontal synchronization signal Hsync, a data enable DE, and a clock signal CLK, which are supplied from the host system 140, and supplies the data control signal to the data driver 120. Additionally, the signal generator 134 generates the gate control signal such that the supply order of scan signals is controlled corresponding to the second data RGB2 in units of the blocks 1001 to 100*j* rearranged by the data modifier 132.

The gate control signal includes gate start pulses GSP1 and GSP2 and the clock signals CLK1, /CLK1, CLK2, and /CLK2. The gate start pulses GSP1 and GSP2 control the timing of a first scan signal. To this end, a first gate start pulse GSP1 is supplied to the first scan driver 108, and a second gate start pulse GSP2 is supplied to the second scan driver 110.

The clock signals CLK1, /CLK1, CLK2, and /CLK2 are used to shift the gate start pulses GSP1 and GSP2. To this end, the first clock signal CLK1 and the inverse first clock signal /CLK1 are supplied to the first scan driver 108, and the second clock signal CLK2 and the inverse second clock signal /CLK2 are supplied to the second scan driver 110.

Here, the high levels of the first clock signal CLK1 and the second clock signal CLK2 do not overlap each other, and the supply order of scan signals in units of blocks is controlled corresponding to the supply order of the first clock signal CLK1 and the second clock signal CLK2. Thus, the signal generator 134 controls the supply order of the clock signals CLK1, /CLK1, CLK2, and /CLK2 such that scan signals are supplied in an order of the first scan line S1, the third scan line S3, the second scan line S2, and the fourth scan line S4 in the first block 1001, corresponding to the second data RGB2.

The data control signal includes a source start pulse SSP, a source sampling clock SSC, a source output enable SOE, a polarity control signal POL, and the like. The source start pulse SSP controls a point of time when data sampling of the data driver 120 starts. The source sampling clock SSC controls a sampling operation of the data driver 120 based on a rising or falling edge. The source output enable SOE controls an output timing of the data driver 120. The polarity control signal POL inverts the polarity of a data signal output from the data driver 120. Here, when video data RGB to be input to the data driver 120 is transmitted based on a mini low voltage differential signaling LVDS interface standard, the source start pulse SSP and the source sampling clock SSC may be omitted.

The data driver 120 generates positive/negative analog data voltages by converting the second data RGB2 input from the timing controller 130 into positive/negative gamma compensation voltages. The positive/negative analog data voltage generated by the data driver 120 is supplied as a data signal to the data lines D.

Here, the data driver 120 supplies a data signal in an order of the first horizontal line, the third horizontal line, the second horizontal line, and the fourth horizontal line, corresponding to the second data RGB2. Then, the data signal may be exactly supplied to the pixels by the scan signals supplied in the order of the first scan line S1, the third scan line S3, the second scan line S2, and the fourth scan line S4 from the scan drivers 108 and 110.

The host system 140 supplies image data RGB to the timing controller 130 through an interface such as a low voltage differential signaling (LVDS) interface or a transition minimized differential signaling (TMDS) interface. The host system 140 supplies the timing signals Vsync, Hsync, DE, and CLK to the timing controller 130.

Figure 2:
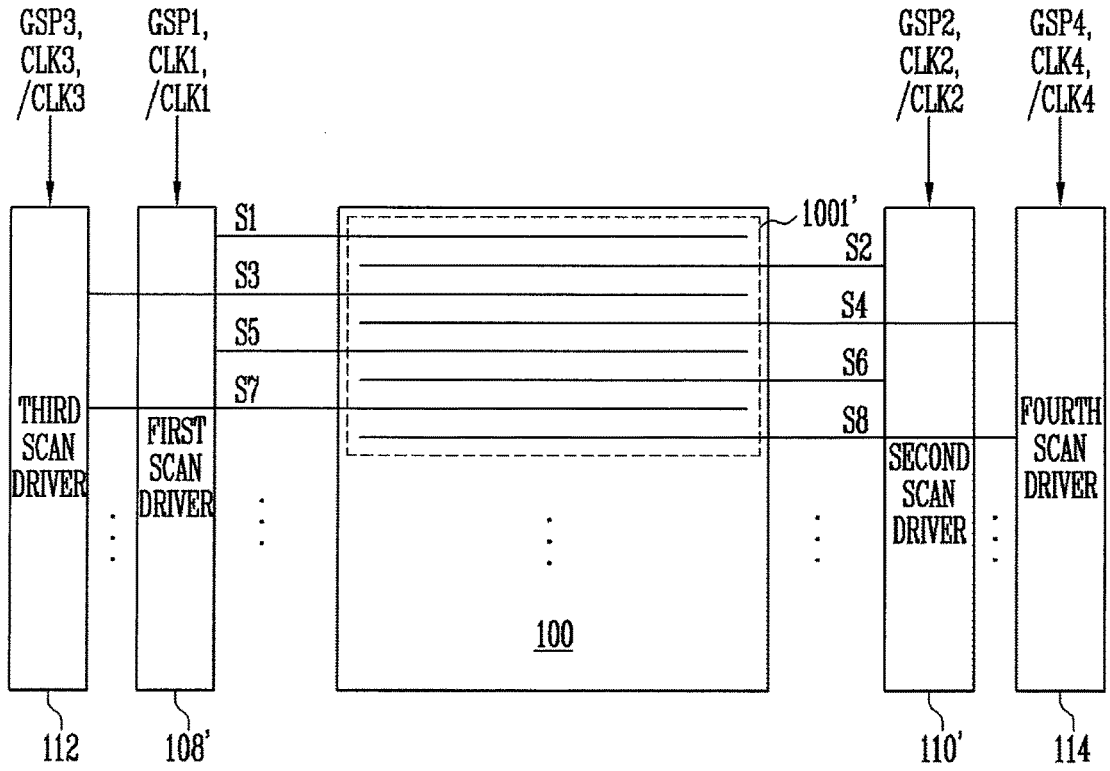
FIG. 2 is a diagram illustrating another embodiment of scan drivers included in the display device.

FIG. 2 is a diagram illustrating another embodiment of the scan drivers included in the display device. In FIG. 2, only the first block included in the pixel unit is shown for convenience of illustration.

Referring to FIG. 2, in the embodiment of the present invention, four scan drivers 108', 110', 112 and 114 are included in the display device. In this case, eight scan lines are included in each block of the pixel unit 100.

The scan drivers 108', 110', 112 and 114 are sequentially coupled to different scan lines. For example, in a first block 1001', a first scan driver 108' sequentially supplies scan signals to a first scan line S1 and a fifth scan line S5, and a second scan driver 110' sequentially supplies scan signals to a second scan line S2 and a sixth scan line S6. In addition, a third scan driver 112 sequentially supplies scan signals to a third scan line S3 and a seventh scan line S7, and a fourth scan driver 114 sequentially supplies scan signals to a fourth scan line S4 and an eighth scan line S8.

The scan drivers 108', 110', 112 and 114 sequentially or non-sequentially control supply orders of scan signals in units of blocks, corresponding to clock signals CLK1, /CLK1, CLK2, /CLK2, CLK3, /CLK3, CLK4, and /CLK4 supplied from the signal generator 134. That is, the supply order of scan signals from the respective scan drivers 108', 110', 112 and 114 may be changed by control of the signal generator 134.

The first scan driver 108' is driven by a first gate start pulse GSP1, a first clock signal CLK1, and an inverse first clock signal /CLK1. The second scan driver 110' is driven by a second gate start pulse GSP2, a second clock signal CLK2, and an inverse second clock signal /CLK2. The third scan driver 112 is driven by a third gate start pulse GSP3, a third clock signal CLK3, and an inverse third clock signal /CLK3. The fourth scan driver 114 is driven by a fourth gate start pulse GSP4, a fourth clock signal CLK4, and an inverse fourth clock signal /CLK4. Here, high levels of the clock signals CLK1, CLK2, CLK3, and CLK4 do not overlap one another.

Figure 3:
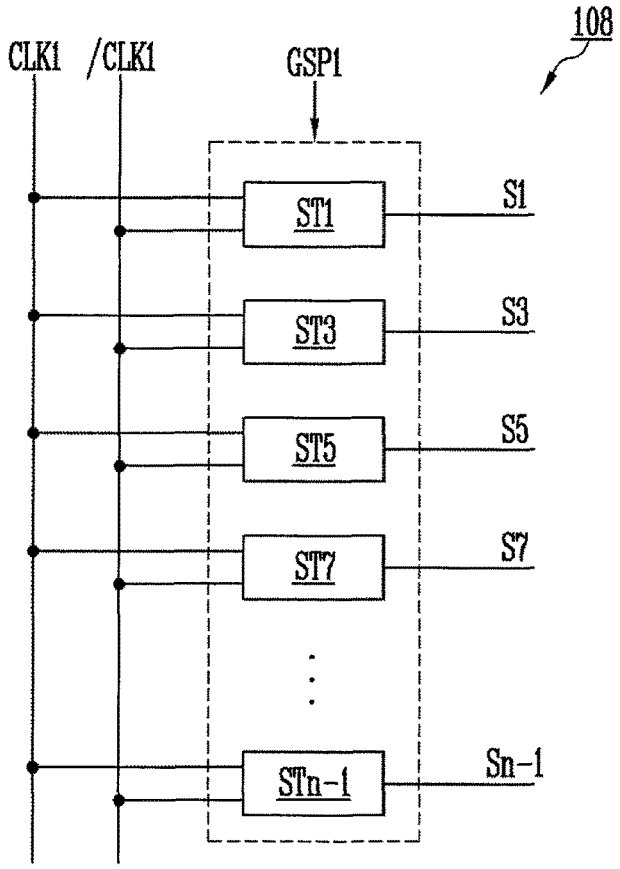
FIG. 3 is a diagram schematically illustrating an embodiment of a first scan driver shown in FIG. 1.

FIG. 3 is a diagram schematically illustrating an embodiment of the first scan driver shown in FIG. 1.

Referring to FIG. 3, the first scan driver 108 according to the embodiment of the present invention includes stages ST1, ST3, . . . , and STn−1. Each of the stages ST1, ST3, . . . , and STn−1 is coupled to any one of the scan lines S1, S3, . . . , and Sn−1. For example, a kth (where k is a natural number) stage STk is coupled to a kth scan line Sk to supply a scan signal to the kth scan line Sk.

A first stage ST1 is supplied with the first gate start pulse GSP1, and supplies a scan signal to the first scan line S1, corresponding to the first clock signal CLK1. Also, the first stage ST1 supplies a first carry signal CR1 to a next stage, corresponding to the inverse first clock signal /CLK1. Here, the first carry signal CR1 supplied to the next stage does not overlap the scan signal supplied to the first scan line S1. The other stages ST3, ST5, . . . , and STn−1, except the first stage ST1, operate identically to the first stage ST1, except that each of the other stages ST3, ST5, . . . , and STn−1 is supplied with a carry signal of a previous stage.

The first clock signal CLK1 is a square wave signal in which a high level and a low level are repeated, and the inverse first clock signal /CLK1 is a signal obtained by inverting the first clock signal CLK1. The high level of the first clock signal CLK1 may be set to a gate-on voltage, and the low level of the first clock signal CLK1 may be set to a gate-off voltage. Similarly, the second clock signal CLK2 supplied to the second scan driver 110 is a square wave signal in which a high level and a low level are repeated, and the inverse second clock signal /CLK2 is a signal obtained by inverting the second clock signal CLK2.

Meanwhile, although not shown in FIG. 3, the first scan driver 108 may additionally include a plurality of dummy stages so as to additionally generate signals supplied from the previous stages. Also, the second scan driver 110 is formed in the same structure as the first scan driver 108, and hence its description may not be repeated.

Figure 4:
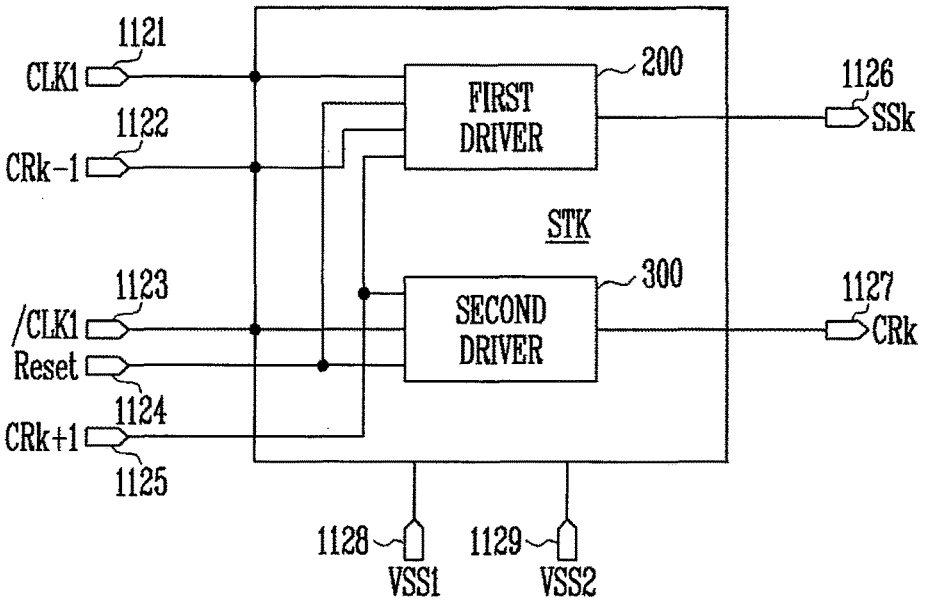
FIG. 4 is a diagram illustrating an embodiment of terminals coupled to a stage.

FIG. 4 is a diagram illustrating an embodiment of terminals coupled to a stage. In FIG. 4, the terminals will be described using the kth stage STk included in the first scan driver 108.

Referring to FIG. 4, the kth stage STk includes a first driver 200 and a second driver 300. The first driver 200 supplies a scan signal SSk to a scan line Sk, corresponding to the first clock signal CLK1. The second driver 300 supplies a carry signal CRk to a previous stage STk−1 and a next stage STk+1, corresponding to the inverse first clock signal /CLK1. Here, supply periods of the carry signal CRk and the scan signal SSk do not overlap each other.

The kth stage STk includes a first input terminal 1121, a second input terminal 1122, a third input terminal 1123, a fourth input terminal 1124, a fifth input terminal 1125, a first output terminal 1126, a second output terminal 1127, a first power input terminal 1128, and a second power input terminal 1129.

The first input terminal 1121 is supplied with the first clock signal CLK1.

The second input terminal 1122 is supplied with a (k−1)th carry signal CRk−1 from the previous stage STk−1.

The third input terminal 1123 is supplied with the inverse first clock signal /CLK1.

The fourth input terminal 1124 is supplied with a reset signal Reset. Here, the reset signal Reset is a signal for setting outputs of all the stages ST1, ST3, . . . , and STn−1 to an off state.

The fifth input terminal 1125 is supplied with a (k+1)th carry signal CRk+1 from the next stage STk+1.

The first output terminal 1126 supplies the scan signal SSk to the kth scan line Sk.

The second output terminal 1127 supplies the carry signal CRk to the previous stage STk−1 and the next stage STk+1.

The first power input terminal 1128 is supplied with a first off voltage VSS1, and the second power input terminal 1129 is supplied with a second off voltage VSS2. Here, the second off voltage VSS2 may be set as a voltage lower than the first off voltage VSS1 so as to completely turn off transistors. Additionally, in embodiments of the present invention, the first off voltage VSS1 and the second off voltages VSS2 are used to completely turn off transistors. However, the present invention is not limited thereto. For example, the second off voltage VSS2 may be supplied to the first power input terminal 1128 and the second power input terminal 1129.

Figure 5A:
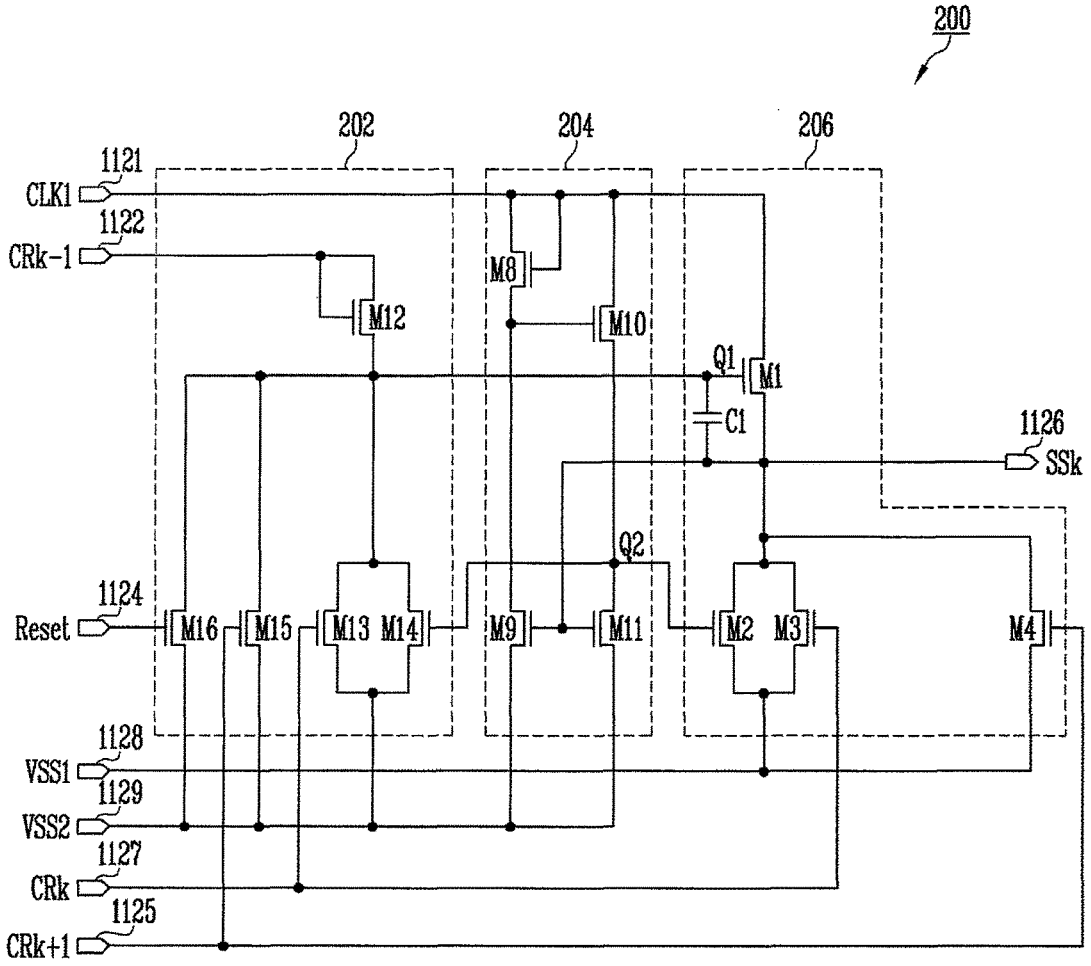
FIG. 5A is a circuit diagram illustrating an embodiment of a first driver shown in FIG. 4.

FIG. 5A is a circuit diagram illustrating an embodiment of the first driver shown in FIG. 4.

Referring to FIG. 5A, the first driver 200 according to the embodiment of the present invention includes a pull-up unit 202, a controller 204 (or a first controller), and an output unit 206 (or a first output unit).

The pull-up unit 202 controls a voltage of a first node Q1, corresponding to the (k−1)th carry signal CRk−1, the kth carry signal CRk, and the reset signal Reset. To this end, the pull-up unit 202 includes twelfth to sixteenth transistors M12 to M16.

A first electrode and a gate electrode of the twelfth transistor M12 are coupled to the second input terminal 1122, and a second electrode of the twelfth transistor M12 is coupled to the first node Q1. The twelfth transistor M12 is turned on when the (k−1)th carry signal CRk−1 is supplied to the second input terminal 1122, to supply a voltage of the (k−1)th carry signal CRk−1, that is, the gate-on voltage to the first node Q1.

The thirteenth transistor M13 is coupled between the first node Q1 and the second power input terminal 1129. A gate electrode of the thirteenth transistor M13 is coupled to the second output terminal 1127. The thirteenth transistor M13 is turned on when the kth carry signal CRk is supplied to the second output terminal 1127, to supply the second off voltage VSS2 to the first node Q1.

The fourteenth transistor M14 is coupled between the first node Q1 and the second power input terminal 1129. A gate electrode of the fourteenth transistor M14 is coupled to a second node Q2. The fourteenth transistor M14 is turned on/off corresponding to a voltage of the second node Q2.

The fifteenth transistor M15 is coupled between the first node Q1 and the second power input terminal 1129. A gate electrode of the fifteenth transistor M15 is coupled to the fifth input terminal 1125. The fifteenth transistor M15 is turned on when the (k+1)th carry signal CRk+1 is supplied to the fifth input terminal 1125, to supply the second off voltage VSS2 to the first node Q1.

The sixteenth transistor M16 is coupled between the first node Q1 and the second power input terminal 1129. A gate electrode of the sixteenth transistor M16 is coupled to the fourth input terminal 1124. The sixteenth transistor M16 is turned on when the reset signal Reset is supplied to the fourth input terminal 1124, to supply the second off voltage VSS2 to the first node Q1.

The controller 204 controls the voltage of the second node Q2, corresponding to the first clock signal CLK1. To this end, the controller 204 includes eighth to eleventh transistors M8 to M11.

A first electrode and a gate electrode of the eighth transistor M8 are coupled to the first input terminal 1121, and a second electrode of the eighth transistor M8 is coupled to a first electrode of the ninth transistor M9 and a gate electrode of the tenth transistor M10. The eighth transistor M8 is diode-coupled, and turned on when the first clock signal CLK1 is supplied to the first input terminal 1121.

The first electrode of the ninth transistor M9 is coupled to the second electrode of the eighth transistor M8, and a second electrode of the ninth transistor M9 is coupled to the second power input terminal 1129. A gate electrode of the ninth transistor M9 is coupled to the first output terminal 1126. The ninth transistor M9 is turned on when the scan signal SSk is supplied to the first output terminal 1126.

A first electrode of the tenth transistor M10 is coupled to the first input terminal 1121, and a second electrode of the tenth transistor M10 is coupled to the second node Q2. The gate electrode of the tenth transistor M10 is coupled to the second electrode of the eighth transistor M8. The tenth transistor M10 controls the coupling between the first input terminal 1121 and the second node Q2, while being turned on/off corresponding to the voltage supplied from the eighth transistor M8.

A first electrode of the eleventh transistor M11 is coupled to the second node Q2, and a second electrode of the eleventh transistor M11 is coupled to the second power input terminal 1129. A gate electrode of the eleventh transistor M11 is coupled to the first output terminal 1126. The eleventh transistor M11 is turned on when the scan signal SSk is supplied to the first output terminal 1126.

The output unit 206 controls a voltage of the first output terminal 1126, corresponding to the first clock signal CLK1, the first node Q1, the second node Q2, the kth carry signal CRk, and the (k+1)th carry signal CRk+1. To this end, the output unit 206 includes first to fourth transistors M1 to M4, and a first capacitor C1.

A first electrode of the first transistor M1 is coupled to the first input terminal 1121, and a second electrode of the first transistor M2 is coupled to the first output terminal 1126. A gate electrode of the first transistor M1 is coupled to the first node Q1. The first transistor M1 controls the coupling between the first input terminal 1121 and the first output terminal 1126 while being turned on/off corresponding to the voltage of the first node Q1.

A first electrode of the second transistor M2 is coupled to the first output terminal 1126, and a second electrode of the second transistor M2 is coupled to the first power input terminal 1128. A gate electrode of the second transistor M2 is coupled to the second node Q2. The second transistor M2 controls the coupling between the first output terminal 1126 and the first power input terminal 1128, while being turned on/off corresponding to the voltage of the second node Q2.

A first electrode of the third transistor M3 is coupled to the first output terminal 1126, and a second electrode of the third transistor M3 is coupled to the first power input terminal 1128. A gate electrode of the third transistor M3 is coupled to the second output terminal 1127. The third transistor M3 is turned on when the kth carry signal CRk is supplied to the second output terminal 1127, to supply the first off voltage VSS1 to the first output terminal 1126.

A first electrode of the fourth transistor M4 is coupled to the first output terminal 1126, and a second electrode of the fourth transistor M4 is coupled to the first power input terminal 1128. A gate electrode of the fourth transistor M4 is coupled to the fifth input terminal 1125. The fourth transistor M4 is turned on when the (k+1)th carry signal CRk+1 is supplied to the fifth input terminal 1125, to supply the first off voltage VSS1 to the first output terminal 1126.

The first capacitor C1 is coupled between the first node Q1 and the first output terminal 1126. The first capacitor C1 functions as a boosting capacitor. In other words, the first capacitor C1 increases the voltage of the first node Q1, corresponding to an increase in the voltage of the first output terminal 1126, when the first transistor M1 is turned on. Accordingly, the first transistor M1 may stably maintain its turn-on state.

Figure 5B:
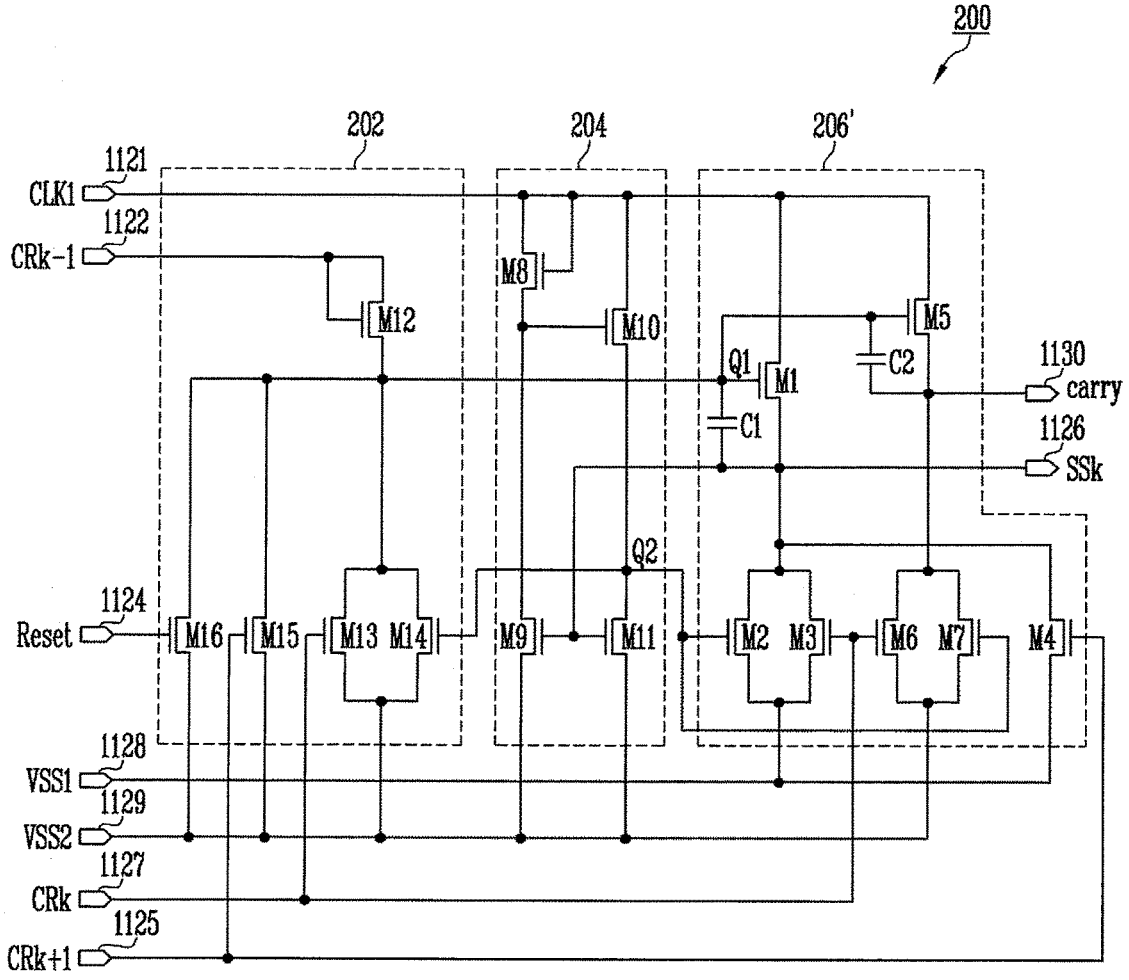
FIG. 5B is a circuit diagram illustrating another embodiment of the first driver shown in FIG. 4.

FIG. 5B is a circuit diagram illustrating another embodiment of the first driver shown in FIG. 4. In FIG. 5B, components identical to those of FIG. 5A are designated by like reference numerals, and their detailed descriptions may not be provided.

Referring to FIG. 5B, the first driver 200 according to the embodiment of the present invention includes the pull-up unit 202, the controller 204, and an output unit 206'.

The output unit 206' additionally generates an internal carry signal Carry as well as the scan signal SSk. Here, the internal carry signal Carry is set to have the same waveform as the scan signal SSk. The internal carry signal Carry generated by the output unit 206' is supplied to the second driver 300. To this end, the output unit 206' additionally includes a fifth transistor M5, a sixth transistor M6, a seventh transistor M7, and a second capacitor C2.

A first electrode of the fifth transistor M5 is coupled to the first input terminal 1121, and a second electrode of the fifth transistor M5 is coupled to a carry terminal 1130. A gate electrode of the fifth transistor M5 is coupled to the first node Q1. The fifth transistor M5 controls the coupling between the first input terminal 1121 and the carry terminal 1130, while being turned on/off corresponding to the voltage of the first node Q1.

A first electrode of the sixth transistor M6 is coupled to the carry terminal 1130, and a second electrode of the sixth transistor M6 is coupled to the second power input terminal 1129. A gate electrode of the sixth transistor M6 is coupled to the second output terminal 1127. The sixth transistor M6 is turned on when the kth carry signal CRk is supplied to the second output terminal 1127, to supply the second off voltage VSS2 to the carry terminal 1130.

A first electrode of the seventh transistor M7 is coupled to the carry terminal 1130, and a second electrode of the seventh transistor M7 is coupled to the second power input terminal 1129. A gate electrode of the seventh transistor M7 is coupled to the second node Q2. The seventh transistor M7 controls the coupling between the carry terminal 1130 and the second power input terminal 1129, while being turned on/off corresponding to the voltage of the second node Q2.

The second capacitor C2 is coupled between the first node Q1 and the carry terminal 1130. The second capacitor C2 functions as a boosting capacitor. In other words, the second capacitor C2 increases the voltage of the first node Q1, corresponding to an increase in the voltage of the carry terminal 1130 when the fifth transistor M5 is turned on. Accordingly, the fifth transistor M5 may stably maintain its turn-on state.

Meanwhile, the first driver 200 of the present invention is not limited to the structures of FIGS. 5A and 5B. For example, the first driver 200 of embodiments of the present invention may be selected as any one of various circuits currently known in the art, which may output scan signals, corresponding to the first clock signal CLK1.

Figure 6:
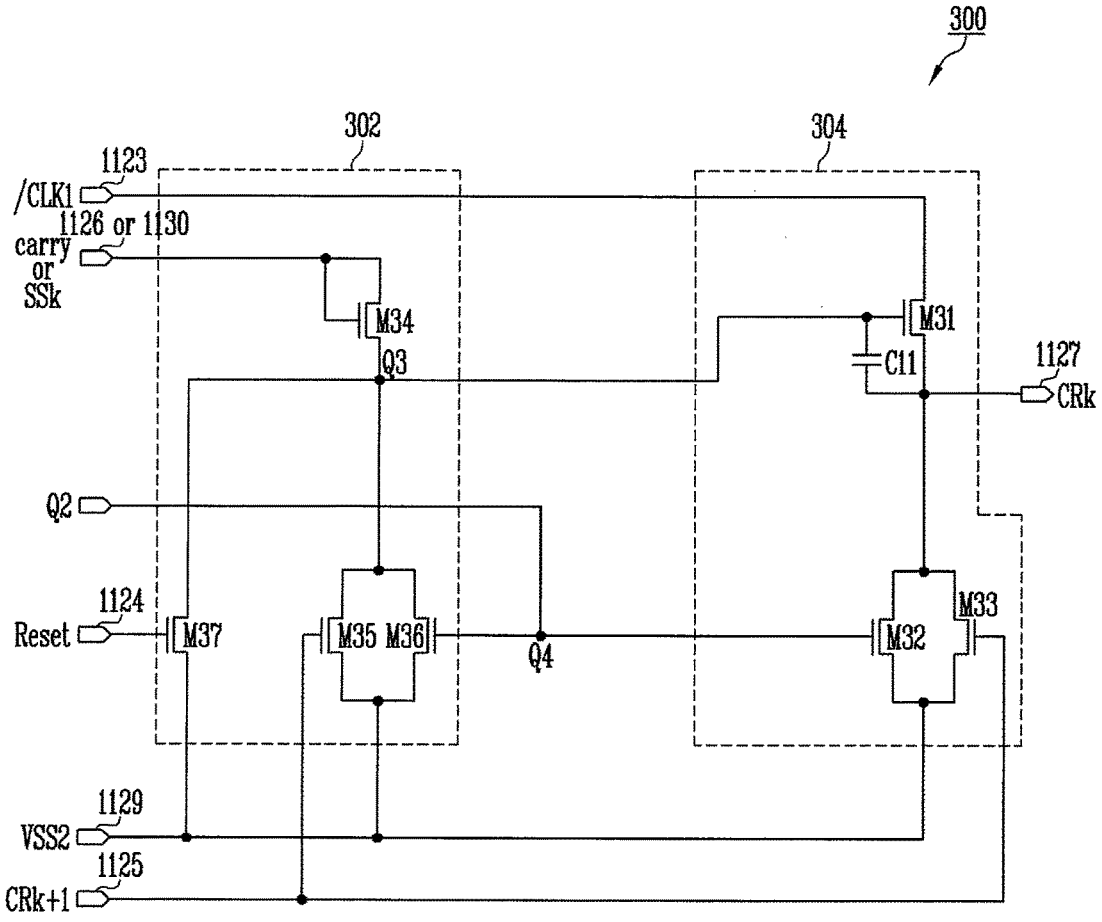
FIG. 6 is a circuit diagram illustrating an embodiment of a second driver shown in FIG. 4.
Figure 7A:
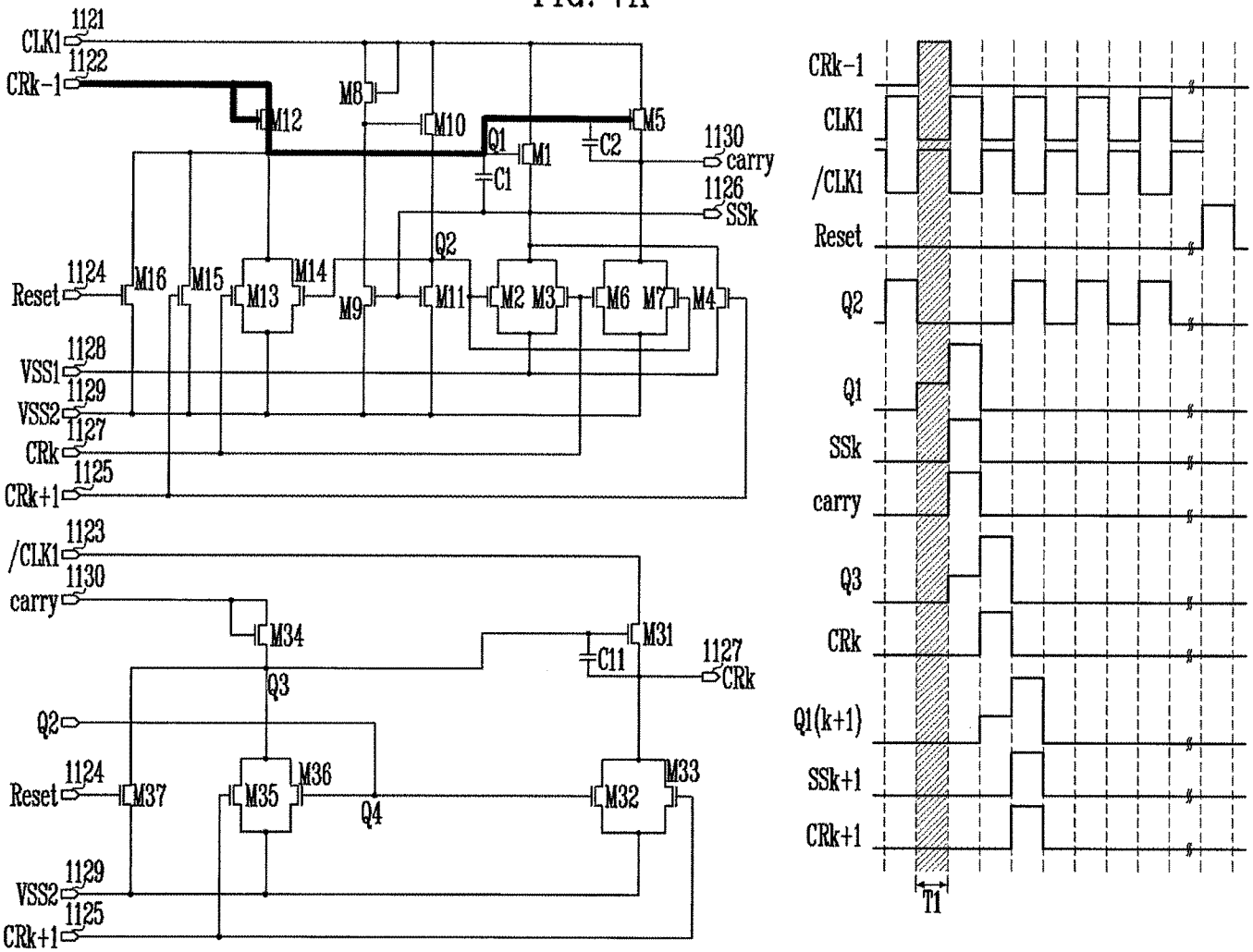
FIGS. 7A-7G are diagrams illustrating embodiments of operating processes of the first driver and the second driver.
Figure 7B:
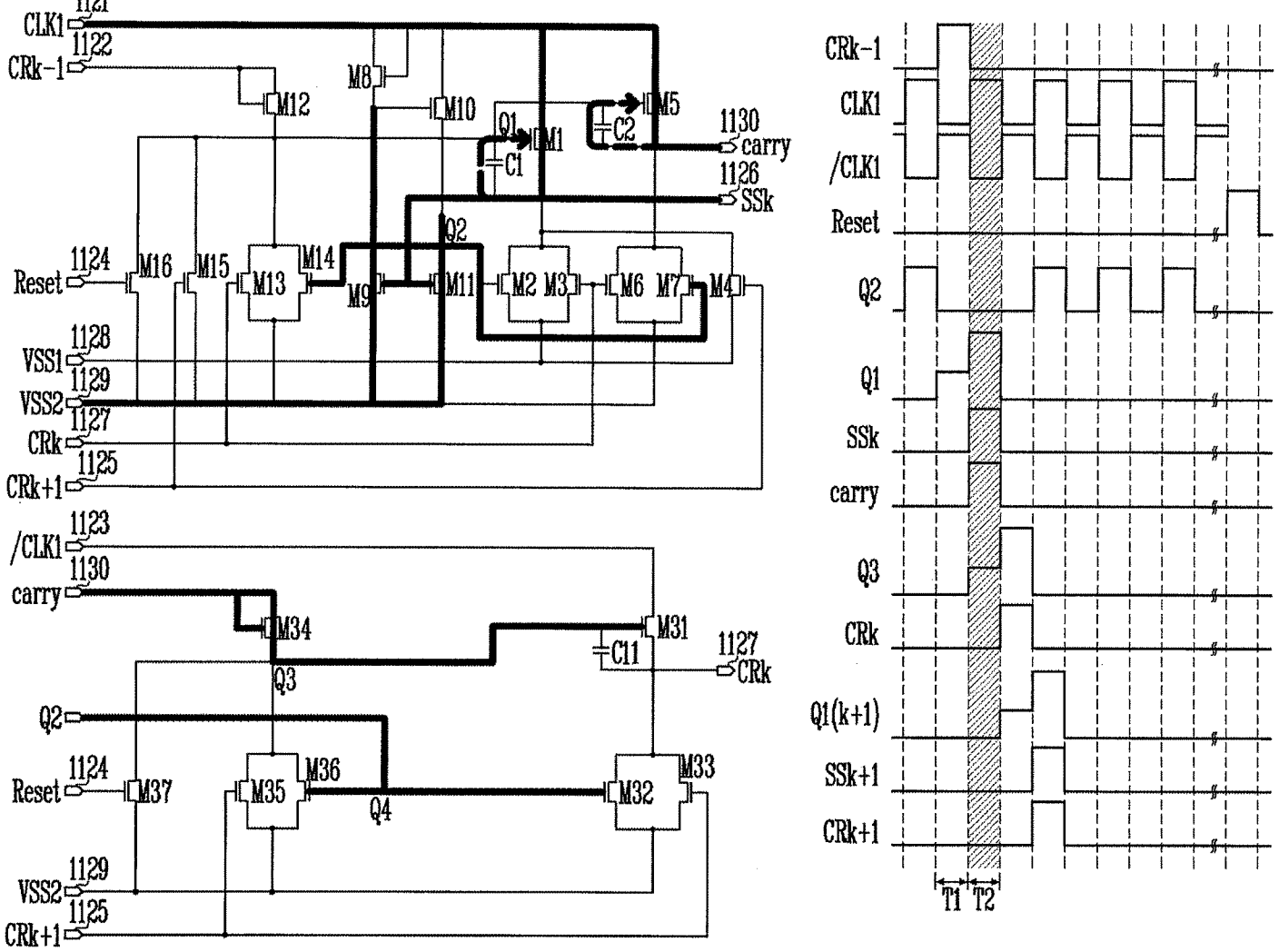
Figure 7C:
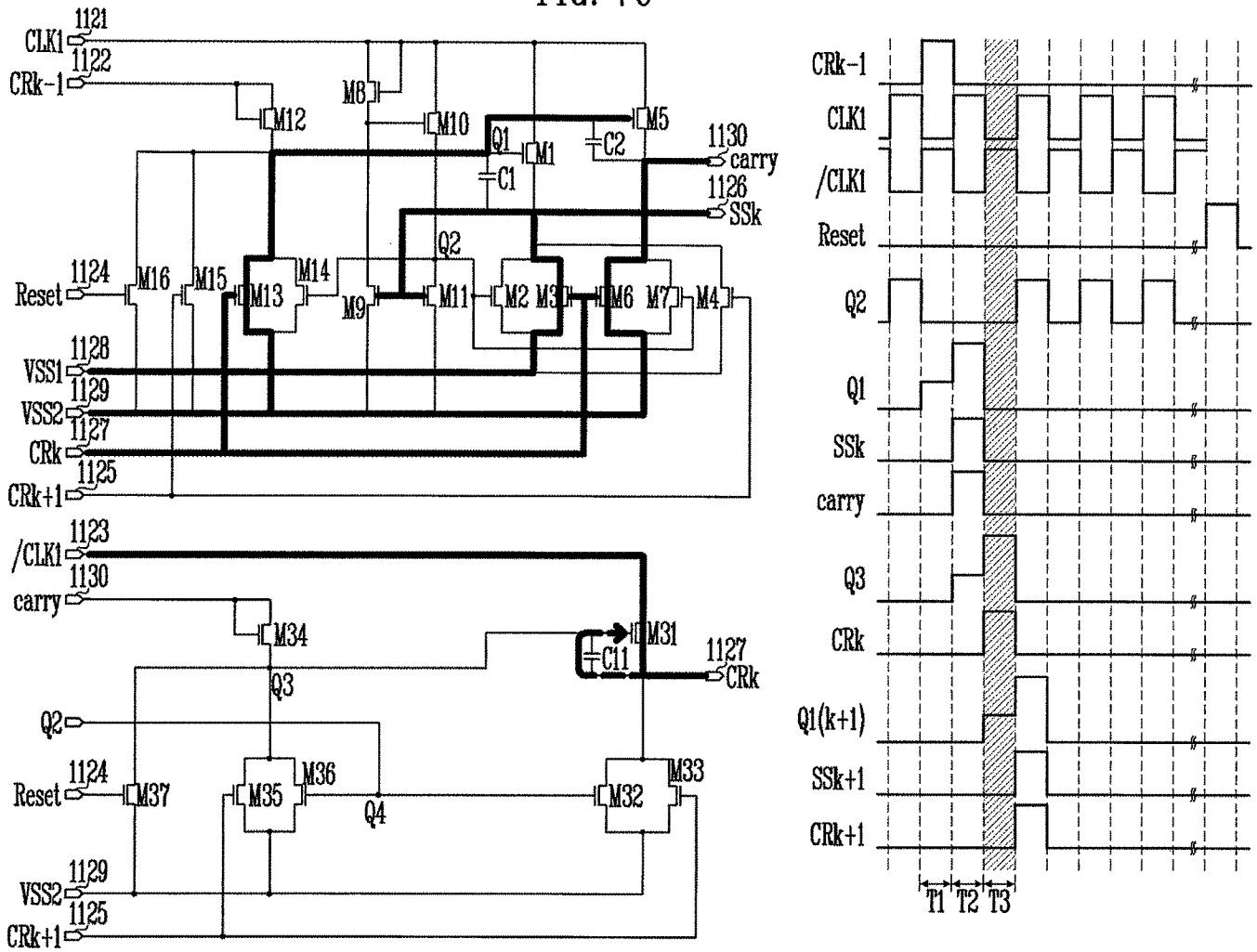
Figure 7D:
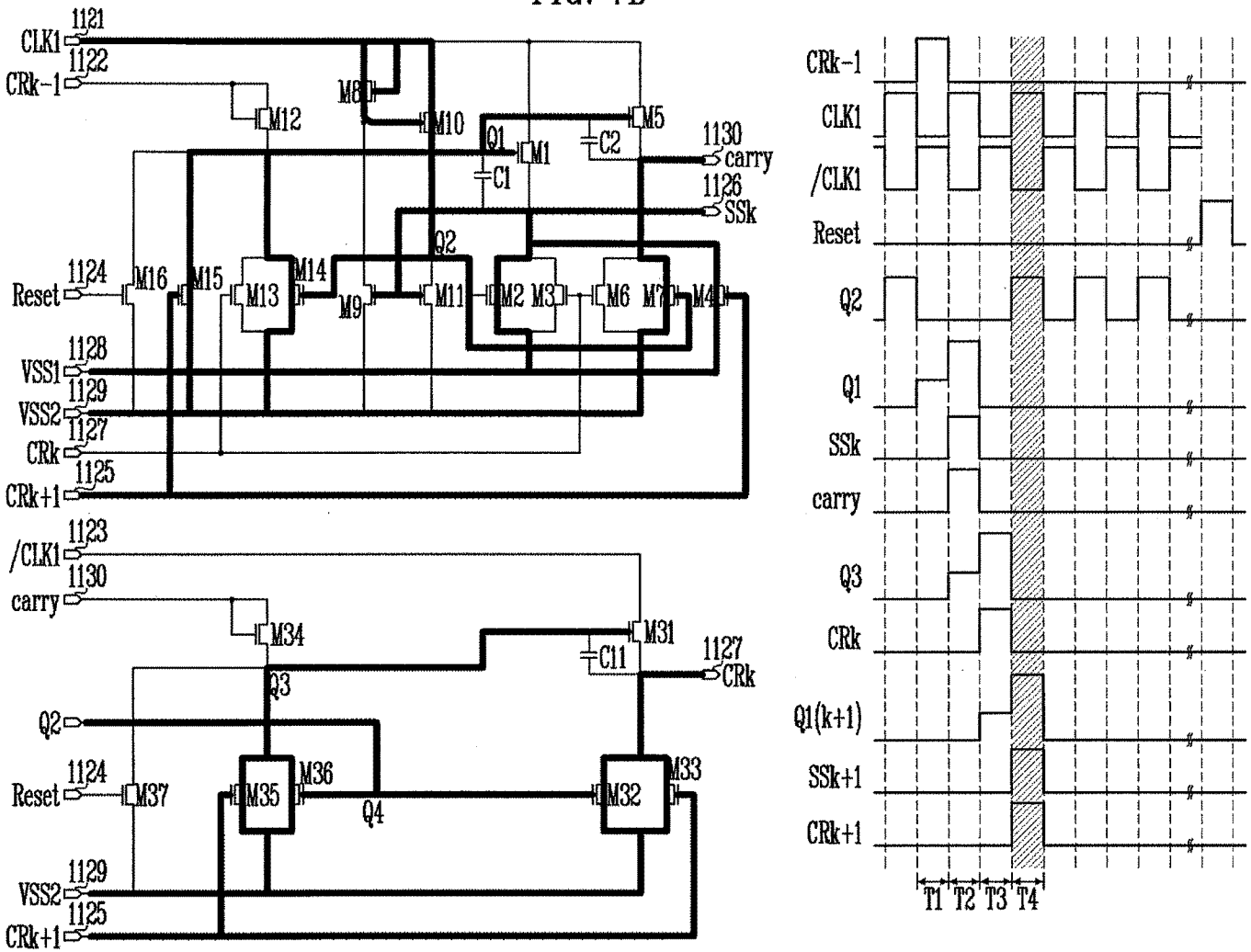
Figure 7E:
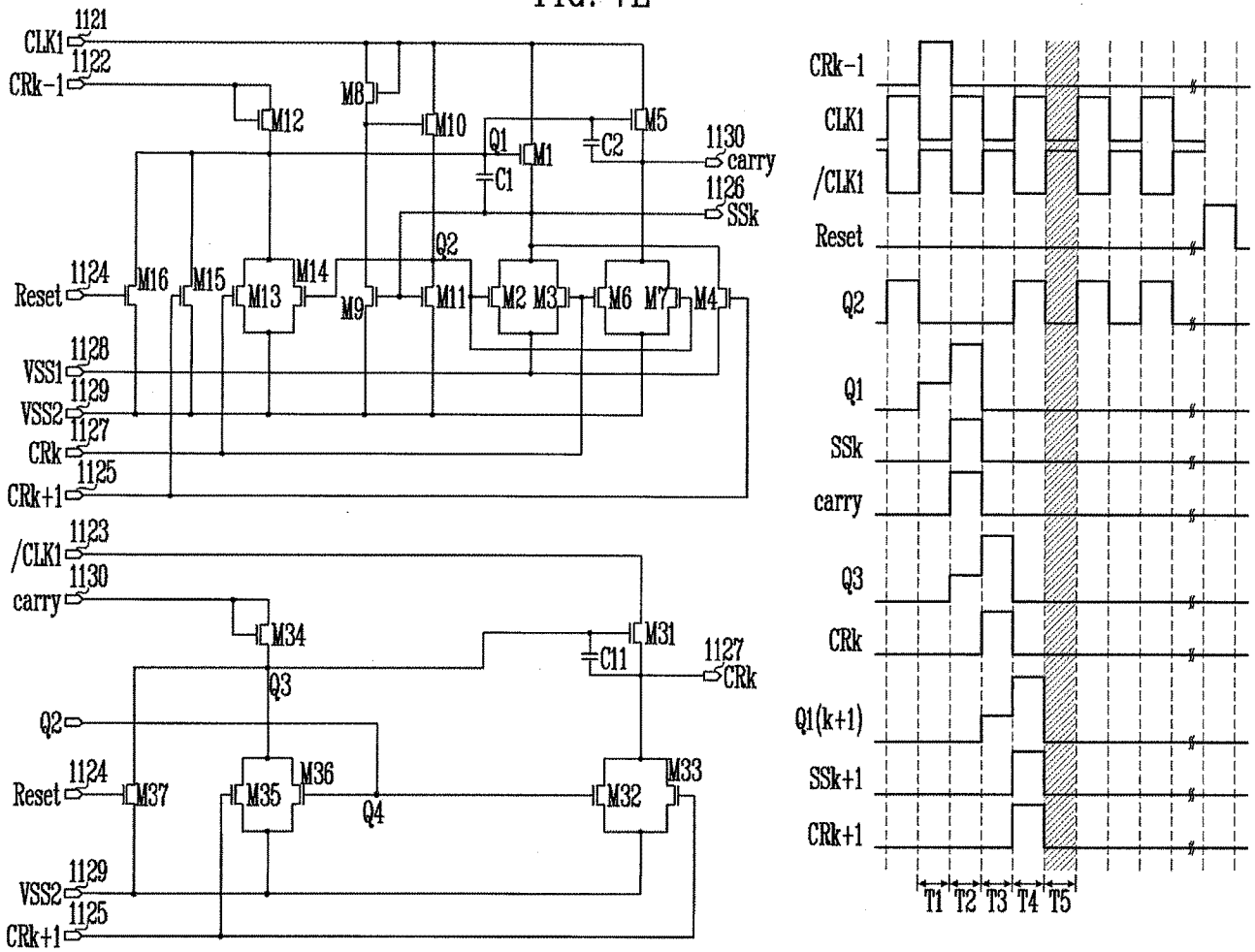
Figure 7F:
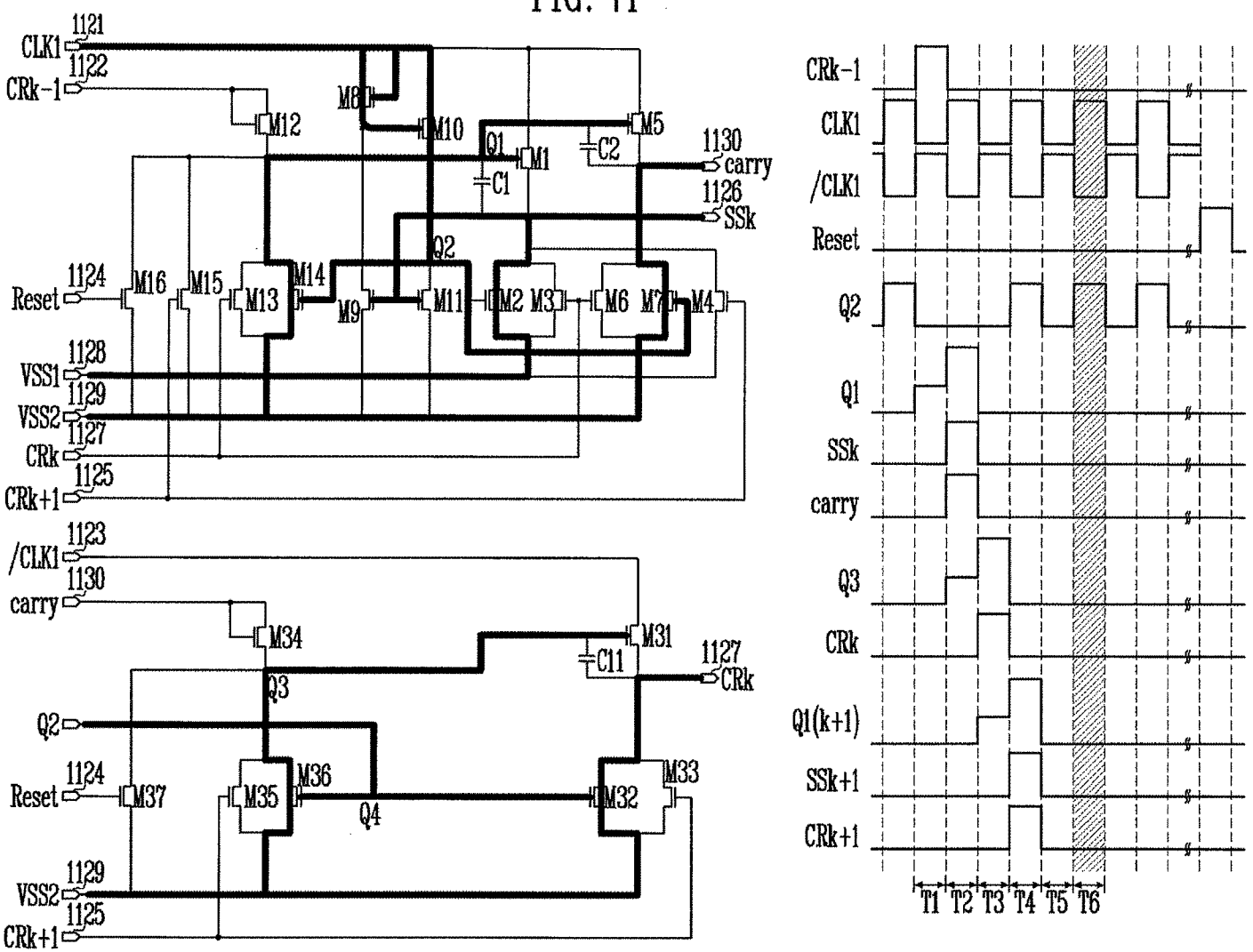
Figure 7G:
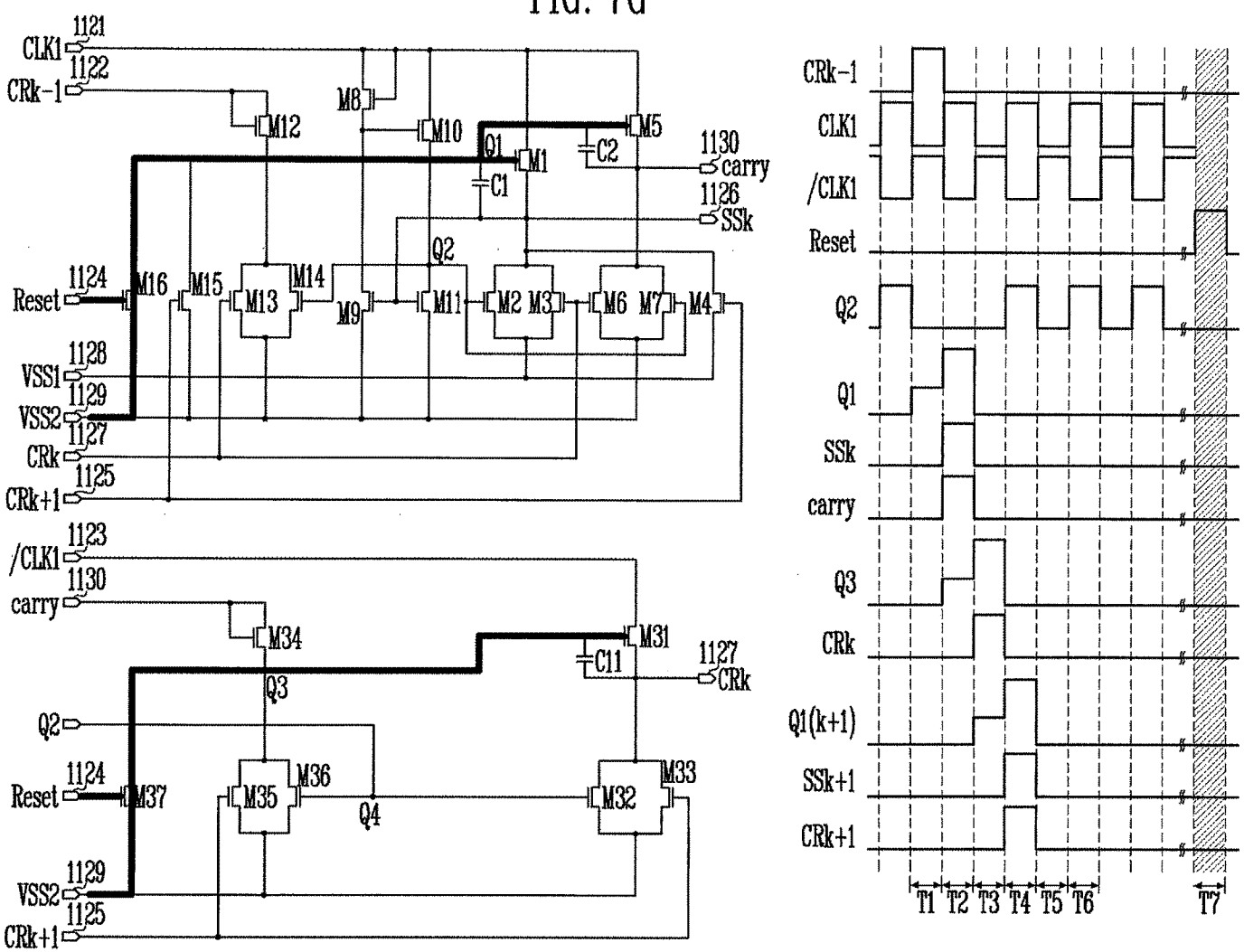

FIG. 6 is a circuit diagram illustrating an embodiment of the second driver shown in FIG. 4. In FIG. 6, it is assumed that, for convenience of illustration, the internal carry signal Carry from the first driver 200 is supplied to the second driver 300.

Referring to FIG. 6, the second driver 300 according to the embodiment of the present invention generates a kth carry signal CRk, corresponding to the internal carry signal Carry (or scan signal SSk) supplied from the first driver 200, and supplies the generated kth carry signal CRk to the previous stage STk−1 and the next stage STk+1. Here, the carry signal CRk generated by the second driver 300 does not overlap the scan signal SSk. Thus, in embodiments of the present invention, the supply timing of the carry signal CRk is controlled, so that the supply order of scan signals may be controlled in unit of blocks.

The second driver 300 according to the embodiment of the present invention includes a second controller 302 and a second output unit 304. A fourth node Q4 included in the second driver 300 is electrically coupled to the second node Q2 of the first driver 200.

The second controller 203 controls a voltage of a third node Q3, corresponding to the internal carry signal Carry, the reset signal Reset, and the (k+1)th carry signal CRk+1. To this end, the second controller 302 includes thirty-fourth to thirty-seventh transistors M34 to M37 (or fourth to seventh transistors).

A first electrode and a gate electrode of the thirty-fourth transistor M34 is coupled to the carry terminal 1130, and a second electrode of the thirty-fourth transistor M34 is coupled to the third node Q3. The thirty-fourth transistor M34 is diode-coupled, to be turned on when the internal carry signal Carry is supplied to the carry terminal 1130. When the thirty-fourth transistor M34 is turned on, the voltage of the internal carry signal Carry, that is, the gate-on voltage is supplied to the third node Q3.

The thirty-fifth transistor M35 is coupled between the third node Q3 and the second power input terminal 1129. A gate electrode of the thirty-fifth transistor M35 is coupled to the fifth input terminal 1125. The thirty-fifth transistor M35 is turned on when the (k+1)th carry signal CRk+1 is supplied to the fifth input terminal 1125, to supply the second off voltage VSS2 to the third node Q3.

The thirty-sixth transistor M36 is coupled between the third node Q3 and the second power input terminal 1129. A gate electrode of the thirty-sixth transistor M36 is coupled to the fourth node Q4. The thirty-sixth transistor M36 is turned on/off corresponding to a voltage of the fourth node Q4.

The thirty-seventh transistor M37 is coupled between the third node Q3 and the second power input terminal 1129. A gate electrode of the thirty-seventh transistor M37 is coupled to the fourth input terminal 1124. The thirty-seventh transistor M37 is turned on when the reset signal Reset is supplied to the fourth input terminal 1124, to supply the second off voltage VSS2 to the third node Q3.

The second output unit 304 supplies the kth carry signal CRk to the second output terminal 1127, corresponding to the inverse first clock signal /CLK1, the third node Q3, the fourth node Q4, and the (k+1)th carry signal CRk+1. To this end, the second output unit 304 includes a thirty-first transistor M31 (or a first transistor), a thirty-second transistor M32 (or a second transistor), a thirty-third transistor M33 (or a third transistor), and an eleventh capacitor C11 (or a first capacitor).

A first electrode of the thirty-first transistor M31 is coupled to the third input terminal 1123, and a second electrode of the thirty-first transistor M31 is coupled to the second output terminal 1127. A gate electrode of the thirty-first transistor M31 is coupled to the third node Q3. The thirty-first transistor M31 is turned on/off corresponding to the voltage of the third node Q3.

A first electrode of the thirty-second transistor M32 is coupled to the second output terminal 1127, and a second electrode of the thirty-second transistor M32 is coupled to the second power input terminal 1129. A gate electrode of the thirty-second transistor M32 is coupled to the fourth node Q4. The thirty-second transistor M32 is turned on/off corresponding to the voltage of the fourth node Q4.

A first electrode of the thirty-third transistor M33 is coupled to the second output terminal 1127, and a second electrode of the thirty-third transistor M33 is coupled to the second power input terminal 1129. A gate electrode of the thirty-third transistor M33 is coupled to the fifth input terminal 1125. The thirty-third transistor M33 is turned on when the (k+1)th carry signal CRk+1 is supplied to the fifth input terminal 1125.

The eleventh capacitor C11 is coupled between the third node Q3 and the second output terminal 1127. The eleventh capacitor C11 functions as a boosting capacitor. In other words, the eleventh capacitor C11 increases the voltage of the third node Q3, corresponding to an increase in the voltage of the second output terminal 1127 when the thirty-first transistor M31 is turned on. Accordingly, the first transistor M31 may stably maintain its turn-on state.

FIGS. 7A to 7G are diagrams illustrating embodiments of operating processes of the first driver and the second driver. In the following description, that a clock signal, a carry signal, and the like are supplied refers to a gate-on voltage; and that the supply of the clock signal, the carry signal, and the like is stopped refers to a gate-off voltage.

Referring to FIGS. 7A to 7G, the (k−1)th carry signal CRk−1 is supplied to the second input terminal 1122 during a first period T1. When the (k−1)th carry signal CRk−1 is supplied to the second input terminal 1122, the twelfth transistor M12 is turned on. When the twelfth transistor M12 is turned on, the (k−1)th carry signal CRk−1 (i.e., the gate-on voltage) is supplied to the first node Q1.

When the (k−1)th carry signal CRk−1 is supplied to the first node Q1, the first transistor M1 and the fifth transistor M5 are turned on. When the first transistor M1 and the fifth transistor M5 are turned on, the first input terminal 1121 is electrically coupled to the first output terminal 1126 and the carry terminal 1130.

The first clock signal CLK1 is supplied to the first input terminal 1121 during a second period T2. In this case, the first transistor M1 and the fifth transistor M5 are set to a turn-on state, and hence the first clock signal CLK1 supplied to the first input terminal 1121 is supplied to the first output terminal 1126 and the carry terminal 1130. Here, the first clock signal CLK1 supplied to the first output terminal 1126 is supplied to the scan signal SSk to the scan line Sk. The first clock signal CLK1 supplied to the carry terminal 1130 is supplied to the internal carry signal Carry to the second driver 300.

Meanwhile, during the second period T2, the voltage of the first node Q1 is increased as a voltage higher than the first clock signal CLK1 by boosting of the first capacitor C1 and the second capacitor C2. Accordingly, the first transistor M1 and the fifth transistor M5 stably maintain the turn-on state.

Additionally, the ninth transistor M9 and the eleventh transistor M11 are turned on by the voltage of the first output terminal 1126 during the second period T2. When the ninth transistor M9 is turned on, the second off voltage VSS2 is supplied to the gate electrode of the tenth transistor M10. When the eleventh transistor M11 is turned on, the second off voltage VSS2 is supplied to the second node Q2. Thus, the second node Q2 is set to the second off voltage VSS2 during the second period T2. Accordingly, the fourteenth transistor M14, the second transistor M2, and the seventh transistor M7 maintain a turn-off state.

Meanwhile, when the first clock signal CLK1 is supplied to the first input terminal 1121, the eighth transistor M8 is turned on. Here, the eighth transistor M8 is diode-coupled. Thus, when the eighth transistor M8 and the ninth transistor M9 have similar channel widths, the voltage of the gate electrode of the tenth transistor M10 is dropped to the second off voltage VSS2.

During the second period T2, the fourth transistor M34 of the second driver 300 is turned on by the internal carry signal Carry supplied to the carry terminal 1130. When the fourth transistor M34 is turned on, the voltage of the third node Q3 rises to the gate-on voltage. When the third node Q3 rises to the gate-on voltage, the thirty-first transistor M31 is turned on. When the thirty-first transistor M31 is turned on, the third input terminal 1123 and the second output terminal 1127 are electrically coupled to each other. In addition, the fourth node Q4 electrically coupled to the second node Q2 is set to the second off voltage VSS2 during the second period T2. Thus, the thirty-second transistor M32 and the thirty-sixth transistor M36 maintain the turn-off state during the second period T2.

The inverse first clock signal /CLK1 is supplied to the third input terminal 1123 during a third period T3. In this case, the thirty-first transistor M31 is set to the turn-on state, and hence the inverse first clock signal /CLK1 supplied to the third input terminal 1123 is supplied to the second output terminal 1127. The inverse first clock signal /CLK1 supplied to the second output terminal 1127 is output as the kth carry signal CRk. The eleventh capacitor C11 increases the voltage of the third node Q3, corresponding to an increase in the voltage of the second output terminal 1127 during the third period T3. Accordingly, the thirty-first transistor M31 maintain the turn-on state.

If the kth carry signal CRk is supplied to the second output terminal 1127, the thirteenth transistor M13, the third transistor M3, and the sixth transistor M6 are turned on.

If the thirteenth transistor M13 is turned on, the second off voltage VSS2 is supplied to the first node Q1. Accordingly, the first transistor M1 and the fifth transistor M5 are turned off.

If the third transistor M3 is turned on, the first off voltage VSS1 is supplied to the first output terminal 1126. When the sixth transistor M6 is turned on, the second off voltage VSS2 is supplied to the carry terminal 1130. When the first off voltage VSS1 is supplied to the first output terminal 1126, the ninth transistor M9 and the eleventh transistor M11 are turned off.

The first clock signal CLK1 is supplied to the first input terminal 1121 during a fourth period T4. When the first clock signal CLK1 is supplied to the first input terminal 1121, the diode-coupled eighth transistor M8 is turned on. Accordingly, the tenth transistor M10 is turned on.

If the tenth transistor M10 is turned on, the voltage of the first clock signal CLK1 is supplied to the second node Q2. When the first clock signal CLK1 is supplied to the second node Q2, the fourteenth transistor M14, the second transistor M2, and the seventh transistor M7 are turned on.

If the fourteenth transistor M14 is turned on, the second off voltage VSS2 is supplied to the first node Q1. When the second transistor M2 is turned on, the first off voltage VSS1 is supplied to the first output terminal 1126. When the seventh transistor M7 is turned on, the second off voltage VSS2 is supplied to the carry terminal 1130.

Also, the (k+1)th carry signal CRk+1 is supplied to the fifth input terminal 1125 during the fourth period T4. Accordingly, the fifteenth transistor M15 and the fourth transistor M4 are turned on. When the fifteenth transistor M15 is turned on, the second off voltage VSS2 is supplied to the first node Q1. When the fourth transistor M4 is turned on, the first off voltage VSS1 is supplied to the first output terminal 1126.

Meanwhile, the first clock signal CLK supplied to the second node Q2 is supplied to the fourth node Q4 during the fourth period T4. When the first clock signal CLK1 is supplied to the fourth node Q4, the thirty-second transistor M32 and the thirty-sixth transistor M36 are turned on. When the thirty-second transistor M32 is turned on, the second off voltage VSS2 is supplied to the second output terminal 1127. When the thirty-sixth transistor M36 is turned on, the second off voltage VSS2 is supplied to the third node Q3. When the second off voltage VSS2 is supplied to the third node Q3, the thirty-first transistor M31 is turned off.

Additionally, the thirty-fifth transistor M35 and the thirty-third transistor M33 are turned on corresponding to the (k+1)th carry signal CRk+1 supplied to the fifth input terminal 1125 during the fourth period T4. When the thirty-fifth transistor M35 is turned on, the second off voltage VSS2 is supplied to the third node Q3. When the thirty-third transistor M33 is turned on, the second off voltage VSS2 is supplied to the second output terminal 1127.

The inverse first clock signal /CLK1 is supplied to the third input terminal 1123 during a fifth period T5. In this case, the thirty-first transistor M31 is set to the turn-off state, and hence the inverse first clock signal /CLK1 is not supplied to the second output terminal 1127.

The first clock signal CLK1 is supplied to the first input terminal 1121 during a sixth period T6. When the first clock signal CLK1 is supplied to the first input terminal 1121, the diode-coupled eighth transistor M8 is turned on. Accordingly, the tenth transistor M10 is turned on.

If the tenth transistor M10 is turned on, the voltage of the first clock signal CLK1 is supplied to the second node Q2. When the first clock signal CLK1 is supplied to the second node Q2, the fourteenth transistor M14, the second transistor M2 and the seventh transistor M7 are turned on.

If the fourteenth transistor M14 is turned on, the second off voltage VSS2 is supplied to the first node Q1. When the second transistor M2 is turned on, the first off voltage VSS1 is supplied to the first output terminal 1126. When the seventh transistor M7 is turned on, the second off voltage VSS2 is supplied to the carry terminal 1130.

Meanwhile, the first clock signal CLK1 supplied to the second node Q2 is supplied to the fourth node Q4 during the sixth period T6. When the first clock signal CLK1 is supplied to the fourth node Q4, the thirty-second transistor M32 and the thirty-sixth transistor M36 are turned on. When the thirty-second transistor M32 is turned on, the second off voltage VSS2 is supplied to the second output terminal 1127. When the thirty-sixth transistor M36 is turned on, the second off voltage VSS2 is supplied to the third node Q3. When the second off voltage VSS2 is supplied to the third node Q3, the thirty-first transistor M31 is turned off.

As described above, the first driver 200 of the present invention supplies a scan signal to the first output terminal 1126, corresponding to the first to sixth periods T1 to T6. In addition, the second driver 300 supplies a carry signal to the second output terminal 1127, corresponding to the first to sixth periods T1 to T6. Here, the carry signal output from the second driver 300 does not overlap the scan signal output from the first driver 200. Thus, when the point of time when the clock signals CLK1 and /CLK1 supplied to the first driver 200 and the second driver 300 is controlled, the supply order of scan signals may be controlled in units of blocks.

Additionally, in embodiments of the present invention, the reset signal Reset may be supplied to the fourth input terminal 1124 during a seventh period T7. When the reset signal Reset is supplied to the fourth input terminal 1124, the sixteenth transistor M16 and the thirty-seventh transistor M37 are turned on.

If the sixteenth transistor M16 is turned on, the second off voltage VSS2 is supplied to the first node Q1. When the thirty-seventh transistor M37 is turned on, the second off voltage VSS2 is supplied to the third node Q3. That is, when the reset signal Reset is supplied, the first node Q1 and the third node Q3 are set to the gate-off voltage. The reset signal Reset may be used to initialize states of the stages.

Figure 8:
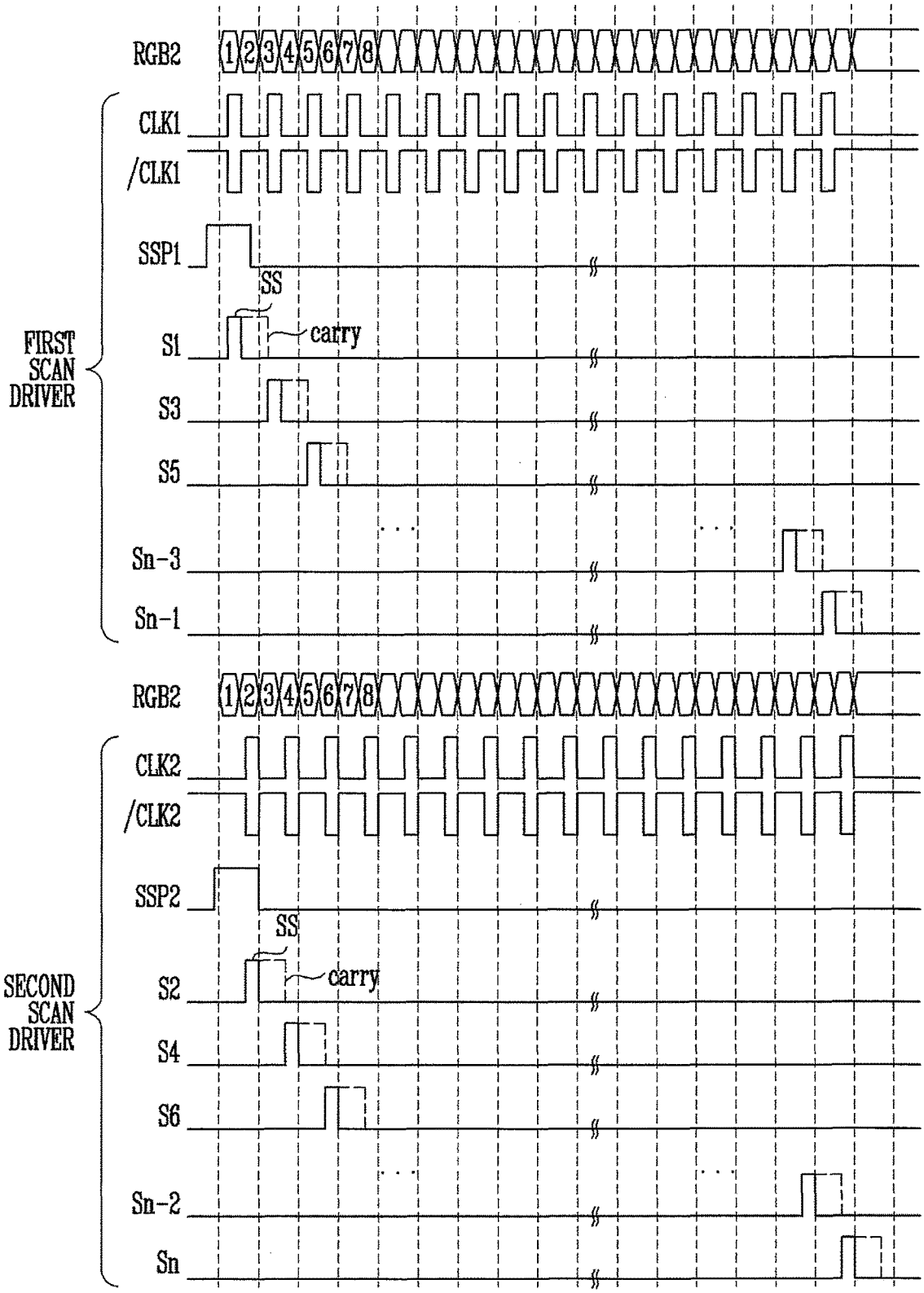
FIG. 8 is a diagram illustrating an embodiment of a supply order of scan signals based on clock signals generated in a signal generator.

FIG. 8 is a diagram illustrating an embodiment of a supply order of scan signals based on clock signals generated in the signal generator. In FIG. 8, a portion indicated by a dotted line refers to a carry signal of a corresponding stage.

Referring to FIG. 8, when the first clock signal CLK1 and the second clock signal CLK2 are sequentially supplied with different phases, scan signals are sequentially supplied to the scan lines S1 to Sn. That is, the scan signal supplied to the odd-numbered scan lines S1, S3, . . . , and Sn−1 by the first clock signal CLK1 and the scan signal supplied to the even-numbered scan lines S2, S4, . . . , and Sn by the second clock signal CLK2 do not overlap each other, and are sequentially output.

Figure 9:
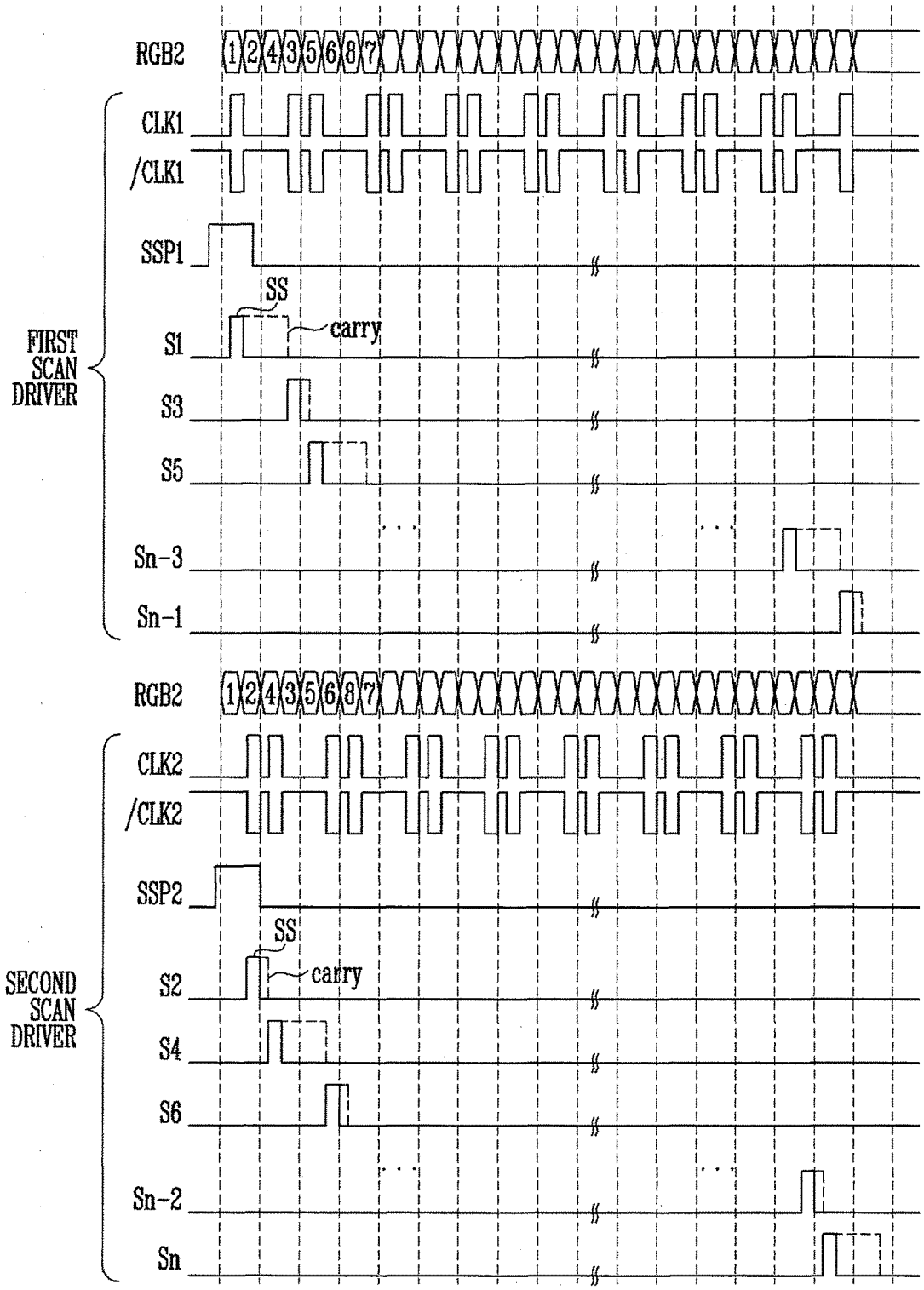
FIG. 9 is a diagram illustrating another embodiment of the supply order of scan signals based on the clock signals generated in the signal generator.

FIG. 9 is a diagram illustrating another embodiment of the supply order of scan signals based on the clock signals generated in the signal generator. In FIG. 9, a portion indicated by a dotted line refers to a carry signal of a corresponding stage.

Referring to FIG. 9, the first clock signal CLK1 is continuously supplied twice, or the second clock signal CLK2 is continuously supplied twice, so that the supply order of scan signals may be controlled in units of blocks.

For example, when the clock signals are supplied in an order of the first clock signal CLK1, the second clock signal CLK2, the second clock signal CLK2, and the first clock signal CLK1, scan signals are supplied in an order of the first scan line S1, the second scan line S2, the fourth scan line S4, and the third scan line S3. That is, the signal generator 134 controls the supply order of the clock signals CLK1, CLK2, /CLK1, and /CLK2, so that the supply order of scan signals may be controlled in units of blocks.

Figure 10:
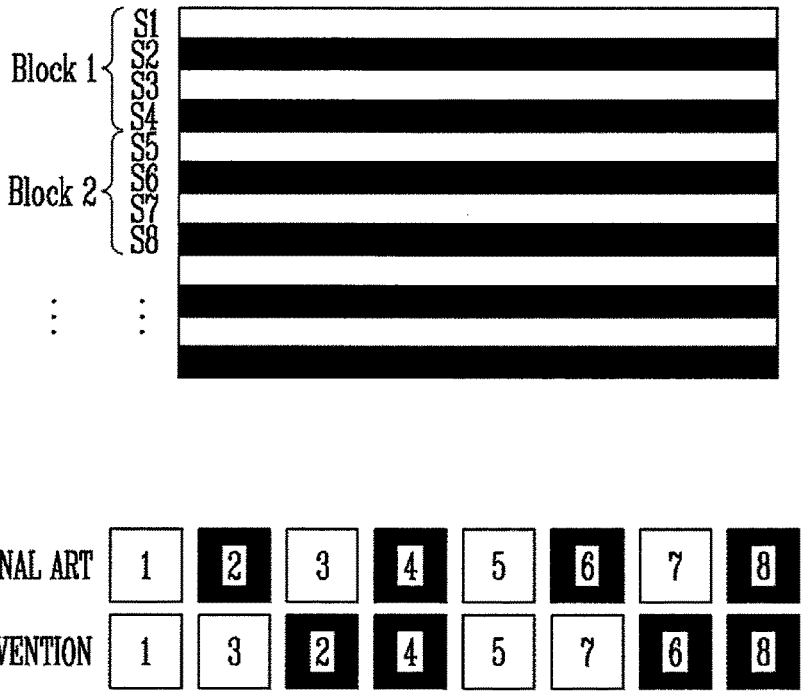
FIG. 10 is a diagram illustrating an embodiment in which the supply order of scan signals is controlled by a data modifier and the signal generator.

FIG. 10 is a diagram illustrating an embodiment in which the supply order of scan signals is controlled by the data modifier and the signal generator.

Referring to FIG. 10, the data modifier 132 generates the second data RGB2 by rearranging the first data RGB1 such that power consumption is reduced or minimized. For example, when the first data RGB1 in which white and black are repeated in units of horizontal lines, the data modifier 132 generates the second data RGB2 by rearranging the first data RGB1 such that data of white and black are continuously supplied in units of the blocks 1001 to 100*j*. In this case, data signals are supplied in an order of the first horizontal line, the third horizontal line, the second horizontal line, and the fourth horizontal line in the first block 1001 by the second data RGB2.

The signal generator 134 supplies scan signals to the first scan driver 108 and the second scan driver 110 by controlling the supply order of the clock signals CLK1, CLK2, /CLK1, and /CLK2 such that the supply order of the scan signals is controlled corresponding to the second data RGB2 in units of the blocks 1001 to 100*j* rearranged by the data modifier 132.

Then, scan signals are supplied in an order of the first scan line S1, the third scan line S3, the second scan line S2, and the fourth scan line S4 in the first block 1001. In this case, data signals having the same voltage are continuously supplied in units of the blocks 1001 to 100*j*, and accordingly, power consumption may be reduced or minimized.

For example, in embodiments of the present invention, the power consumption may be decreased by about 28%, as compared with the related art in which scan signals are sequentially supplied. Further, when the four scan drivers 108', 110', 112, and 114 are included in the display device, the power consumption may be decreased by about 75%, as compared with the related art.

It will be understood that, although the terms "first", "second", "third", etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section discussed below could be termed a second element, component, region, layer or section, without departing from the spirit and scope of the inventive concept.

In addition, it will also be understood that when a layer is referred to as being "between" two layers, it can be the only layer between the two layers, or one or more intervening layers may also be present.

The terminology used herein is for the purpose of describing particular embodiments and is not intended to be limiting of the inventive concept. As used herein, the singular forms "a" and "an" are intended to include the plural forms as well, unless the context clearly indicates otherwise. It will be further understood that the terms "include," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list. Further, the use of "may" when describing embodiments of the inventive concept refers to "one or more embodiments of the inventive concept." Also, the term "exemplary" is intended to refer to an example or illustration.

It will be understood that when an element or layer is referred to as being "on", "connected to" or "coupled to" another element or layer, it can be directly on, connected to or coupled to the other element or layer, or one or more intervening elements or layers may be present. When an element or layer is referred to as being "directly on," "directly connected to", or "directly coupled to" another element or layer, there are no intervening elements or layers present.

As used herein, the term "substantially," "about," and similar terms are used as terms of approximation and not as terms of degree, and are intended to account for the inherent variations in measured or calculated values that would be recognized by those of ordinary skill in the art.

As used herein, the terms "use," "using," and "used" may be considered synonymous with the terms "utilize," "utilizing," and "utilized," respectively.

The scan driver and/or any other relevant devices or components according to embodiments of the present invention described herein may be implemented utilizing any suitable hardware, firmware (e.g. an application-specific integrated circuit), software, or a suitable combination of software, firmware, and hardware. For example, the various components of the scan driver may be formed on one integrated circuit (IC) chip or on separate IC chips. Further, the various components of the scan driver may be implemented on a flexible printed circuit film, a tape carrier package (TCP), a printed circuit board (PCB), or formed on a same substrate. Further, the various components of the scan driver may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the scope of the exemplary embodiments of the present invention.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims, and equivalents thereof.

What is claimed is:

1. A scan driver comprising:

a plurality of stages coupled to respective scan lines, wherein a kth (where k is a natural number) stage of the plurality of stages comprises:

a first driver configured to supply a kth scan signal to a first output terminal, based on a first clock signal; and a second driver configured to supply a kth carry signal not overlapping the kth scan signal to a second output terminal, based on an inverse first clock signal.

2. The scan driver of claim 1, wherein the first driver comprises:

a first output unit configured to supply the kth scan signal to the first output terminal, based on the first clock signal input to a first input terminal, a (k+1)th carry signal input to a fifth input terminal, the kth carry signal, and voltages of a first node and a second node;

a first controller configured to control the voltage of the second node, based on the first clock signal; and a pull-up unit configured to control the voltage of the first node, based on a (k−1)th carry signal input to a second input terminal, a reset signal input to a fourth input terminal, and the kth carry signal.

3. The scan driver of claim 2, wherein the first output unit is further configured to generate an internal carry signal having a same waveform as the kth scan signal.

4. The scan driver of claim 3, wherein the second driver comprises:

a second output unit configured to supply the kth carry signal to the second output terminal, based on the inverse first clock signal input to a third input terminal, the (k+1)th carry signal, and voltages of a third node and a fourth node electrically coupled to the second node; and a second controller configured to control the voltage of the third node, based on the kth scan signal or the internal carry signal, the reset signal, and the (k+1)th carry signal.

5. The scan driver of claim 4, wherein the second output unit comprises:

a first transistor coupled between the third input terminal and the second output terminal, the first transistor having a gate electrode coupled to the third node;

a second transistor coupled between the second output terminal and a second power input terminal supplied with a second off voltage, the second transistor having a gate electrode coupled to the fourth node;

a third transistor coupled between the second output terminal and the second power input terminal, the third transistor having a gate electrode coupled to the fifth input terminal; and a first capacitor coupled between the third node and the second output terminal.

6. The scan driver of claim 4, wherein the second controller comprises:

a fourth transistor configured to be diode-coupled, and to turn on when the kth scan signal or the internal carry signal is supplied to increase the voltage of the third node to a gate-on voltage;

a fifth transistor coupled between the third node and a second power input terminal supplied with a second off voltage, the fifth transistor having a gate electrode coupled to the fifth input terminal;

a sixth transistor coupled between the third node and the second power input terminal, the sixth transistor having a gate electrode coupled to the fourth node; and a seventh transistor coupled between the third node and the second power input terminal, the seventh transistor having a gate electrode coupled to the fourth input terminal.

7. The scan driver of claim 3, wherein the first output unit comprises:

a first transistor coupled between the first input terminal and the first output terminal, the first transistor having a gate electrode coupled to the first node;

a second transistor coupled between the first output terminal and a first power input terminal supplied with a first off voltage, the second transistor having a gate electrode coupled to the second node;

a third transistor coupled between the first output terminal and the first power input terminal, the third transistor having a gate electrode coupled to the second output terminal;

a fourth transistor coupled between the first output terminal and the first power input terminal, the fourth transistor having a gate electrode coupled to the fifth input terminal; and a first capacitor coupled between the first node and the first output terminal.

8. The scan driver of claim 7, wherein the first output unit comprises:

a fifth transistor coupled between the first input terminal and a carry terminal to output the internal carry signal, the fifth transistor having a gate electrode coupled to the first node;

a sixth transistor coupled between the carry terminal and a second power input terminal supplied with a second off voltage, the second off voltage being different from the first off voltage, the sixth transistor having a gate electrode coupled to the second output terminal; and a seventh transistor coupled between the carry terminal and the second power input terminal, the seventh transistor having a gate electrode coupled to the second node.

9. The scan driver of claim 2, wherein the first controller comprises:

an eighth transistor having a first electrode and a gate electrode, coupled to the first input terminal;

a ninth transistor coupled between a second electrode of the eighth transistor and a second power input terminal supplied with a second off voltage, the ninth transistor having a gate electrode coupled to the first output terminal;

a tenth transistor coupled between the first input terminal and the second node, the tenth transistor having a gate electrode coupled to the second electrode of the eighth transistor; and an eleventh transistor coupled between the second node and the second power input terminal, the eleventh transistor having a gate electrode coupled to the first output terminal.

10. The scan driver of claim 2, wherein the pull-up unit comprises:

a twelfth transistor having a gate electrode and a first electrode, coupled to the second input terminal;

a thirteenth transistor coupled between a second electrode of the twelfth transistor and a second power input terminal supplied with a second off voltage, the thirteenth transistor having a gate electrode coupled to the second output terminal;

a fourteenth transistor coupled between the second electrode of the twelfth transistor and the second power input terminal, the fourteenth transistor having a gate electrode coupled to the second node;

a fifteenth transistor coupled between the first node and the second power input terminal, the fifteenth transistor having a gate electrode coupled to the fifth input terminal; and a sixteenth transistor coupled between the first node and the second power input terminal, the sixteenth transistor having a gate electrode coupled to the fourth input terminal.

11. A display device comprising:

i (where i is a natural number of 2 or more) scan drivers configured to supply scan signals to scan lines;

a plurality of blocks, each of the plurality of blocks comprising 2i scan lines;

a data modifier configured to generate second data by rearranging first data supplied from the outside in units of the blocks; and a signal generator configured to sequentially or non-sequentially control a supply order of scan signals in units of the blocks, based on the second data, wherein each of the i scan drivers comprises a plurality of stages, and wherein at least one of the plurality of stages comprises:

a first driver configured to supply a kth scan signal to a first output terminal, based on a first clock signal; and a second driver configured to supply a kth carry signal not overlapping the kth scan signal to a second output terminal, based on an inverse first clock signal.

12. The display device of claim 11, wherein the signal generator is configured to supply a clock signal and an inverse clock signal to each of the i scan drivers, and wherein high periods of clock signals supplied to the respective i scan drivers do not overlap each other.

13. The display device of claim 12, wherein the i scan drivers are sequentially coupled to different scan lines in each of the blocks.

14. The display device of claim 13, wherein the signal generator is further configured to control the supply order of the scan signals in units of the blocks by controlling a supply order of clock signals and inverse clock signals respectively supplied to the i scan drivers.

15. The display device of claim 13, wherein each of the i scan drivers is configured to sequentially supply scan signals to scan lines coupled thereto.

16. The display device of claim 11, wherein the first driver comprises:

a first output unit configured to supply the kth scan signal to the first output terminal, based on the first clock signal input to a first input terminal, a (k+1)th carry signal input to a fifth input terminal, the kth carry signal, and voltages of a first node and a second node;

a first controller configured to control the voltage of the second node, based on the first clock signal; and a pull-up unit configured to control the voltage of the first node, based on a (k−1)th carry signal input to a second input terminal, a reset signal input to a fourth input terminal, and the kth carry signal.

17. The display device of claim 16, wherein the second driver comprises:

a second output unit configured to supply the kth carry signal to the second output terminal, based on the inverse first clock signal input to a third input terminal, the (k+1)th carry signal, and voltages of a third node and a fourth node electrically coupled to the second node; and a second controller configured to control the voltage of the third node, based on the kth scan signal, the reset signal, and the (k+1)th carry signal.

18. The display device of claim 17, wherein the second output unit comprises:

a first transistor coupled between the third input terminal and the second output terminal, the first transistor having a gate electrode coupled to the third node;

a second transistor coupled between the second output terminal and a second power input terminal supplied with a second off voltage, the second transistor having a gate electrode coupled to the fourth node;

a third transistor coupled between the second output terminal and the second power input terminal, the third transistor having a gate electrode coupled to the fifth input terminal; and a first capacitor coupled between the third node and the second output terminal.

19. The display device of claim 17, wherein the second controller comprises:

a fourth transistor configured to be diode-coupled, and to turn on when the kth scan signal is supplied to increase the voltage of the third node to a gate-on voltage;

a fifth transistor coupled between the third node and a second power input terminal supplied with a second off voltage, the fifth transistor having a gate electrode coupled to the fifth input terminal;

a sixth transistor coupled between the third node and the second power input terminal, the sixth transistor having a gate electrode coupled to the fourth node; and a seventh transistor coupled between the third node and the second power input terminal, the seventh transistor having a gate electrode coupled to the fourth input terminal.

* * * * *